US011084289B2

(12) United States Patent
Sasaki

(10) Patent No.: US 11,084,289 B2
(45) Date of Patent: Aug. 10, 2021

(54) INKJET PRINTING APPARATUS

(71) Applicant: CANON KABUSHIKI KAISHA, Tokyo (JP)

(72) Inventor: Takashi Sasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/592,275

(22) Filed: Oct. 3, 2019

(65) Prior Publication Data

US 2020/0108609 A1 Apr. 9, 2020

(30) Foreign Application Priority Data

Oct. 5, 2018 (JP) ..... JP2018-189636

(51) Int. Cl.
*B41J 2/165* (2006.01)

(52) U.S. Cl.
CPC ..... *B41J 2/16517* (2013.01); *B41J 2/16508* (2013.01); *B41J 2/16523* (2013.01); *B41J 2/16588* (2013.01); *B41J 2002/16594* (2013.01)

(58) Field of Classification Search
CPC ..... B41J 2/16517; B41J 2/16588; B41J 2/16508; B41J 2/16523; B41J 2002/16594
See application file for complete search history.

(56) References Cited

U.S. PATENT DOCUMENTS

2008/0049064 A1* 2/2008 Asai ..... B41J 2/16532 347/30
2015/0042718 A1 2/2015 Kameyama

FOREIGN PATENT DOCUMENTS

JP 2002273913 A 9/2002
JP 2015033780 A 2/2015

* cited by examiner

*Primary Examiner* — Geoffrey S Mruk
(74) *Attorney, Agent, or Firm* — Venable LLP

(57) ABSTRACT

To provide an inkjet printing apparatus that is capable of reducing a collision noise made by a roller and a tube during a suctioning operation, the position of the roller relative to the tube is changed between the suctioning operation and a stopped time.

9 Claims, 15 Drawing Sheets

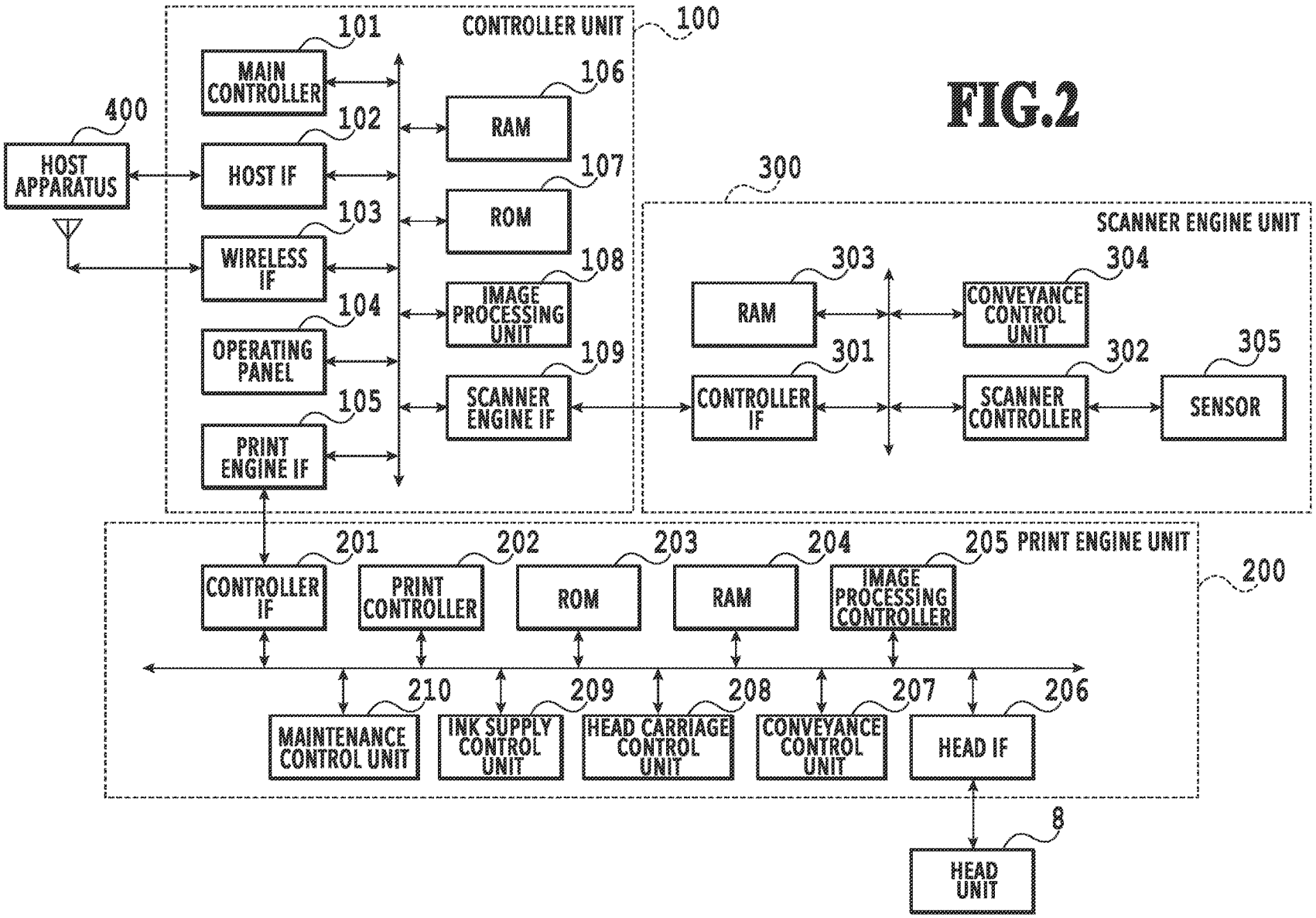
FIG.2
100
CONTROLLER UNIT
101
MAIN CONTROLLER
102
HOST IF
103
WIRELESS IF
104
OPERATING PANEL
105
PRINT ENGINE IF
106
RAM
107
ROM
108
IMAGE PROCESSING UNIT
109
SCANNER ENGINE IF
400
HOST APPARATUS
300
SCANNER ENGINE UNIT
301
CONTROLLER IF
302
SCANNER CONTROLLER
303
RAM
304
CONVEYANCE CONTROL UNIT
305
SENSOR
200
205 PRINT ENGINE UNIT
201
CONTROLLER IF
202
PRINT CONTROLLER
203
ROM
204
RAM
205
IMAGE PROCESSING CONTROLLER
206
HEAD IF
207
CONVEYANCE CONTROL UNIT
208
HEAD CARRIAGE CONTROL UNIT
209
INK SUPPLY CONTROL UNIT
210
MAINTENANCE CONTROL UNIT
8
HEAD UNIT

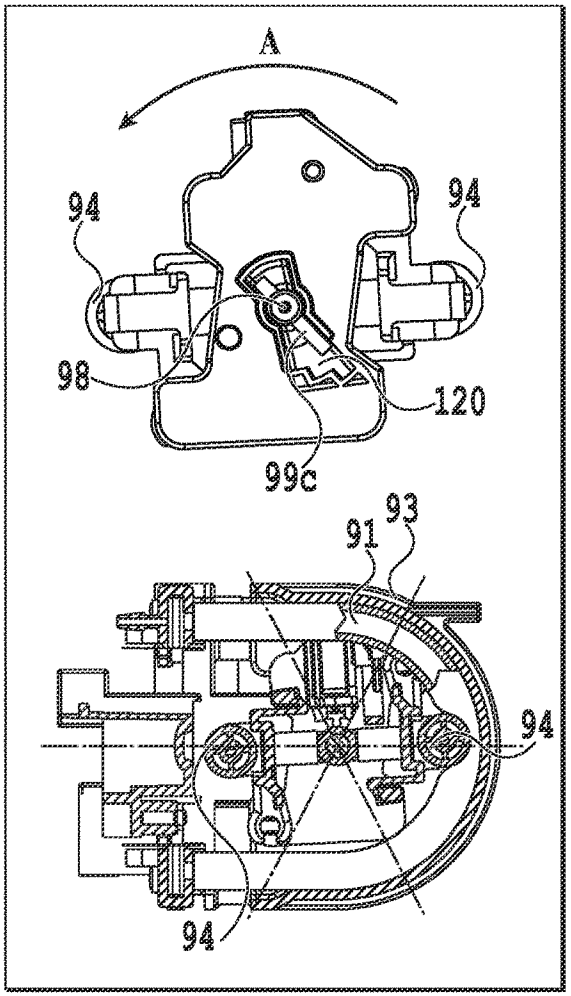
FIRST ROW
FIG.10A
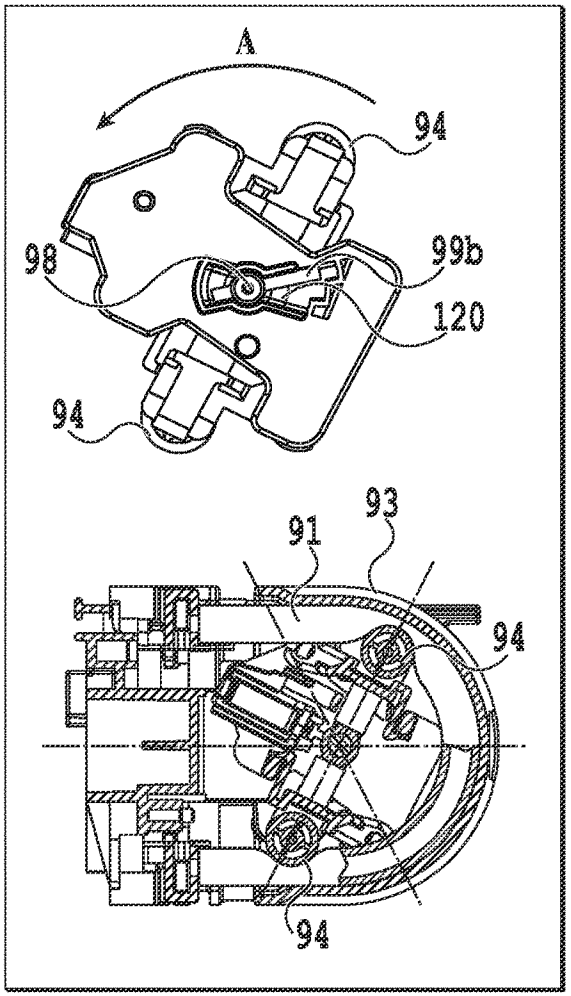
SECOND ROW
FIG.10B
THIRD ROW
FIG.10C

THIRD ROW

SECOND ROW

FIRST ROW

THIRD ROW DURING SUCTIONING OPERATION

THIRD ROW DURING STOPPED TIME

INKJET PRINTING APPARATUS

BACKGROUND OF THE INVENTION

Field of the Invention

The present invention relates to a liquid ejection apparatus including a print head that ejects liquid (ink) to print an image, and more particularly, to an inkjet printing apparatus that performs a suctioning operation by use of a tube pump.

Description of the Related Art

In Japanese Patent Laid-Open No. 2015-33780, it is disclosed that, during a suctioning operation by use of a tube pump, even though a roller of the tube pump is repelled by the elasticity of the tube when the roller is detached from the tube, the roller comes into contact with another tube, and therefore it is possible to suppress a noise that occurs when the roller is detached from the tube.

In an apparatus using a tube pump, if the tube pump is in a stopped state for a long time, a tube of the tube pump is in a state of being pressed by a roller for a long time, and therefore the part pressed by the roller may be deformed. Then, when the stopped state of the apparatus is cancelled and the tube pump starts operating, a collision noise (noise) occurs in a case where the roller passes through the deformed portion of the tube. The volume of this noise becomes louder if a plurality of rollers simultaneously pass through deformed portions of the tube. Japanese Patent Laid-Open No. 2015-33780 does not refer to suppression of the volume of the noise caused by such deformation of the tube.

SUMMARY OF THE INVENTION

Thus, the present invention provides an inkjet printing apparatus that is capable of reducing a collision noise made by a roller and a tube during a suctioning operation.

Therefore, an inkjet printing apparatus of the present invention includes: a cap configured to cap an ejection opening surface of a print head that ejects ink; a first tube formed of a flexible member and connected to the cap; a second tube formed of a flexible member and connected to the cap, the second tube being different from the first tube; a first roller configured to be capable of moving while applying pressure to a predetermined area of the first tube; a second roller configured to be capable of moving while applying pressure to a predetermined area of the second tube; a driving unit configured to drive the first roller and the second roller to move while the first roller and the second roller keep applying pressure to the first tube and the second tube, respectively; and a position fixing unit configured to fix a position of the first roller and a position of the second roller such that, in a case where the driving unit is operating, the second roller is positioned at a first position relative to the first roller and, in a case where the driving unit is stopped, the second roller is positioned at a second position relative to the first roller, the second position being different from the first position.

According to the present invention, it is possible to realize an inkjet printing apparatus that is capable of reducing a collision noise made by a roller and a tube during a suctioning operation.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIG. 10A is a diagram illustrating a phase of a pump wheel unit during a suctioning operation;

FIG. 10B is a diagram illustrating a phase of a pump wheel unit during the suctioning operation;

FIG. 10C is a diagram illustrating a phase of a pump wheel unit during the suctioning operation;

DESCRIPTION OF THE EMBODIMENTS

Hereinafter, an explanation is given of an embodiment of the present invention with reference to the drawings.

Figure 1:
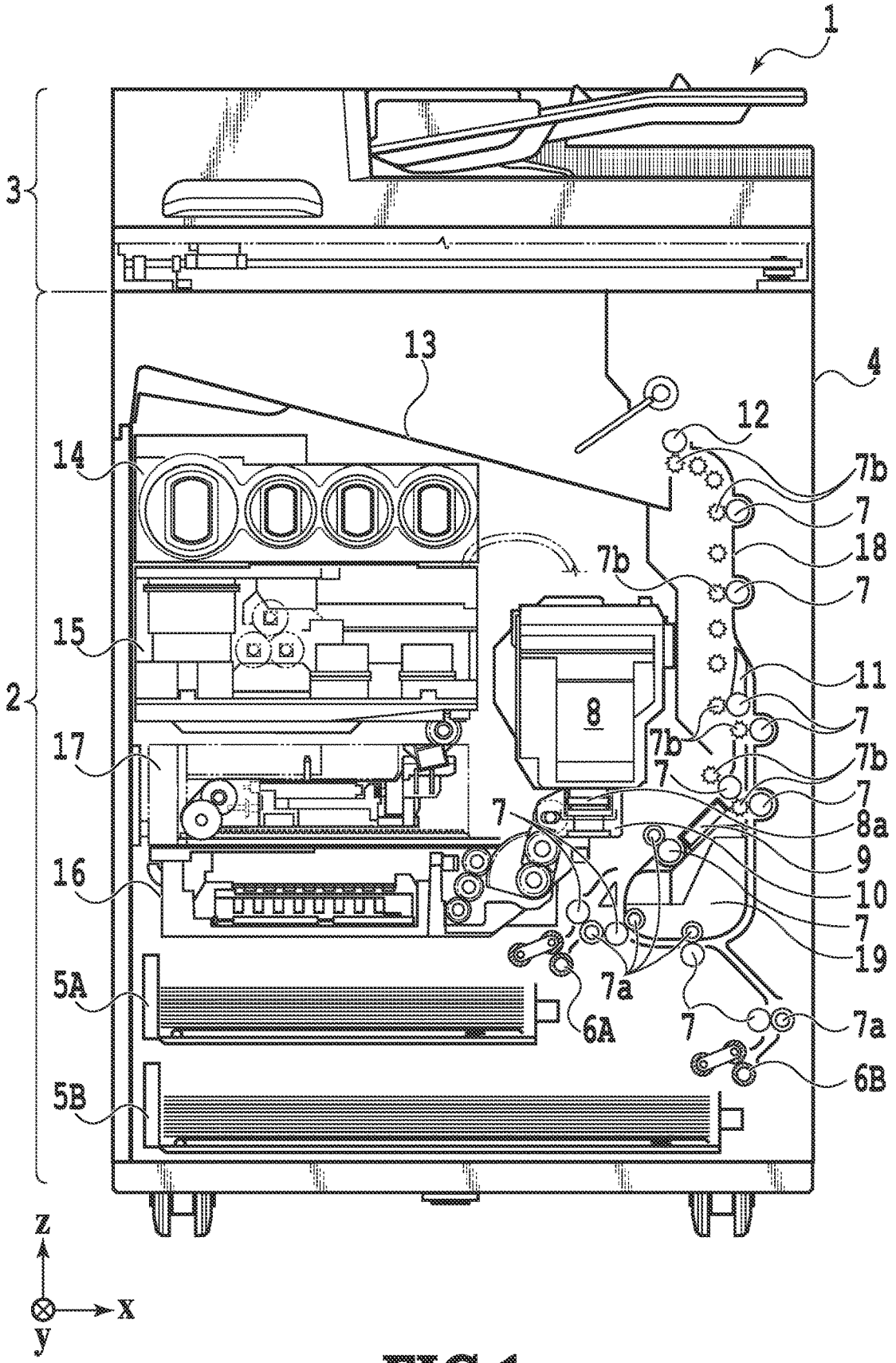
FIG. 1 is a diagram of a printing apparatus being in a standby state.

FIG. 1 is an internal configuration diagram of an inkjet printing apparatus 1 (hereinafter referred to as a printing apparatus 1) used in the present embodiment. In the drawings, x-direction is a horizontal direction; y-direction (i.e., a direction perpendicular to the plane of paper) is a direction in which ejection openings are arrayed in the later-described print head 8; and z-direction is a vertical direction.

The printing apparatus 1 is a multifunctional peripheral provided with a print unit 2 and a scanner unit 3. The printing apparatus 1 is capable of utilizing the print unit 2 and the scanner unit 3 separately or in synchronization to execute various processes related to a print operation and a scan operation. The scanner unit 3 is provided with an automatic document feeder (ADF) and a flatbed scanner (FBS). The scanner unit 3 is capable of scanning a document automatically fed by the ADF and reading (scanning) a document placed by a user on a document plate of the FBS. Note that, although the present embodiment is directed to the multifunctional peripheral including both the print unit 2 and the scanner unit 3, there may be a mode in which the scanner unit 3 is not included. FIG. 1 is a diagram illustrating the printing apparatus 1 being in a standby state, in which neither a print operation nor a scan operation is performed.

In the print unit 2, a first cassette 5A and a second cassette 5B for housing a print medium (i.e., cut sheet) S are provided in an attachable/detachable manner at the bottom of a casing 4 in the vertical direction. A relatively small print medium of up to A4 size is stacked and housed in the first cassette 5A and a relatively large print medium of up to A3 size is stacked and housed in the second cassette 5B. Near the first cassette 5A, a first feeding unit 6A for separately feeding each of the housed print media is provided. Similarly, near the second cassette 5B, a second feeding unit 6B is provided. When a print operation is performed, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers provided on the upstream side and on the downstream side relative to the print head 8 and driven by a conveying motor, which is not herein illustrated. The pinch rollers 7*a* are follower rollers that rotate while nipping a print medium S together with the conveying rollers 7. The discharging roller 12 is a drive roller provided on the downstream side relative to the conveying rollers 7 and driven by the conveying motor, which is not herein illustrated. The spurs 7*b* nip and convey a print medium S together with the discharging roller 12 and the conveying rollers 7 provided on the downstream side relative to the print head 8.

The guide 18 is provided in the conveyance path of a print medium S to guide a print medium S in a predetermined direction. The inner guide 19 is a member extending in y-direction. The inner guide 19 has a curved side surface and guides a print medium S along the side surface. The flapper 11 is a member for changing directions in which a print medium S is conveyed in a duplex print operation. A discharging tray 13 is a tray for loading/retaining a print medium S discharged by the discharging roller 12 after a print operation is completed.

The print head 8 of the present embodiment is a full line type color inkjet print head. In the print head 8, a plurality of ejection openings for ejecting ink in accordance with print data are arrayed in y-direction of FIG. 1 so as to correspond to widths of print media S. That is, the print head 8 is configured to be capable of ejecting ink of a plurality of colors. When the print head 8 is in a standby position, an ejection opening surface 8*a* of the print head 8 is oriented downward in the vertical direction and capped by a cap unit 10 as illustrated in FIG. 1. When a print operation is performed, the orientation of the print head 8 is changed by the later-described print controller 202 such that the ejection opening surface 8*a* faces a platen 9. The platen 9 is configured with a flat plate extending in y-direction. The platen 9 supports a print medium S, to which a print operation is performed by the print head 8, from the back side. The movement of the print head 8 from the standby position to a printing position will be explained later in detail.

An ink tank unit 14 separately stores ink of four colors to be supplied to the print head 8. An ink supply unit 15 is provided in the midstream of a flow path connecting the ink tank unit 14 and the print head 8. The ink supply unit 15 adjusts the pressure and the flow rate of ink in the print head 8 within a suitable range. The present embodiment adopts a circulation type ink supply system, in which the ink supply unit 15 adjusts the pressure of ink supplied to the print head 8 and the flow rate of ink collected from the print head 8 within a suitable range.

A maintenance unit 16 is provided with the cap unit 10 and a wiping unit 17. The maintenance unit 16 operates the cap unit 10 and the wiping unit 17 at predetermined timings, so as to perform a maintenance operation for the print head 8. The maintenance operation will be explained later in detail.

FIG. 2 is a block diagram illustrating a control configuration of the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. The print controller 202 controls various mechanisms of the print engine unit 200 in accordance with instructions from a main controller 101 of the controller unit 100. Various mechanisms of the scanner engine unit 300 are controlled by the main controller 101 of the controller unit 100. The control configuration will be explained below in detail.

In the controller unit 100, the main controller 101, which is configured with a CPU, controls the entire printing apparatus 1 by use of a RAM 106 as a work in accordance with various parameters and a program stored in a ROM 107. For example, in a case where a print job is input from a host apparatus 400 via a host I/F 102 or a wireless I/F 103, an image processing unit 108 performs predetermined image processing for received image data in accordance with instructions from the main controller 101. Then, the main controller 101 transmits the image data, for which the image processing has been performed, to the print engine unit 200 via a print engine I/F 105.

Note that the printing apparatus 1 may obtain image data from the host apparatus 400 via a wireless communication or a wired communication or may obtain image data from an external storage device (such as a USB memory) connected to the printing apparatus 1. There is no limitation on the communication system utilized for the wireless communication or the wired communication. For example, Wi-Fi (Wireless Fidelity; registered trademark), Bluetooth (registered trademark), or the like, is applicable for the communication system utilized for the wireless communication. Further, a USB (Universal Serial Bus), or the like, is applicable for the communication system utilized for the wired communication. Moreover, for example, in a case where a scan command is input by the host apparatus 400, the main controller 101 transmits the command to the scanner unit 3 via a scanner engine I/F 109.

An operating panel 104 is a mechanism for a user to provide an input or output operation for the printing apparatus 1. Via the operating panel 104, a user can provide an instruction for an operation such as copying or scanning, set a print mode, and recognize information about the printing apparatus 1, etc.

In the print engine unit 200, the print controller 202, which is configured with a CPU, controls various mechanisms provided in the print unit 2 by use of a RAM 204 as a work area in accordance with various parameters and a program stored in a ROM 203. Once various commands and image data are received via a controller I/F 201, the print controller 202 temporarily stores the various commands and the image data in the RAM 204. The print controller 202 causes an image processing controller 205 to convert the stored image data into print data, so that the print head 8 utilizes the print data in a print operation.

After the print data is generated, the print controller 202 causes the print head 8 via a head I/F 206 to execute a print operation based on the print data. Here, the print controller 202 drives the feeding units 6A and 6B, the conveying rollers 7, the discharging roller 12, and the flapper 11 illustrated in FIG. 1 via a conveyance control unit 207, so as to convey a print medium S. The print operation by the print head 8 is executed in synchronization with the conveyance operation of the print medium S in accordance with an instruction from the print controller 202, such that the print processing is performed.

A head carriage control unit 208 changes orientations and positions of the print head 8 in accordance with operation states of the printing apparatus 1 such as a maintenance state and a printing state. An ink supply control unit 209 controls the ink supply unit 15 such that the pressure of ink supplied to the print head 8 is controlled within a suitable range. A maintenance control unit 210 controls operations of the cap unit 10 and the wiping unit 17 in the maintenance unit 16 in a case of performing a maintenance operation for the print head 8.

In the scanner engine unit 300, the main controller 101 controls hardware resources of the scanner controller 302 by use of the RAM 106 as a work area in accordance with various parameters and a program stored in the ROM 107. Thereby, various mechanisms provided in the scanner unit 3 are controlled. For example, the main controller 101 controls hardware resources in the scanner controller 302 via a controller I/F 301, so that a document placed on the ADF by a user is conveyed via a conveyance control unit 304 and scanned by a sensor 305. Then, the scanner controller 302 stores scanned image data in a RAM 303. Note that the print controller 202 is capable of converting such image data obtained as described above into print data to enable the print head 8 to execute a print operation based on image data scanned by the scanner controller 302.

Figure 3:
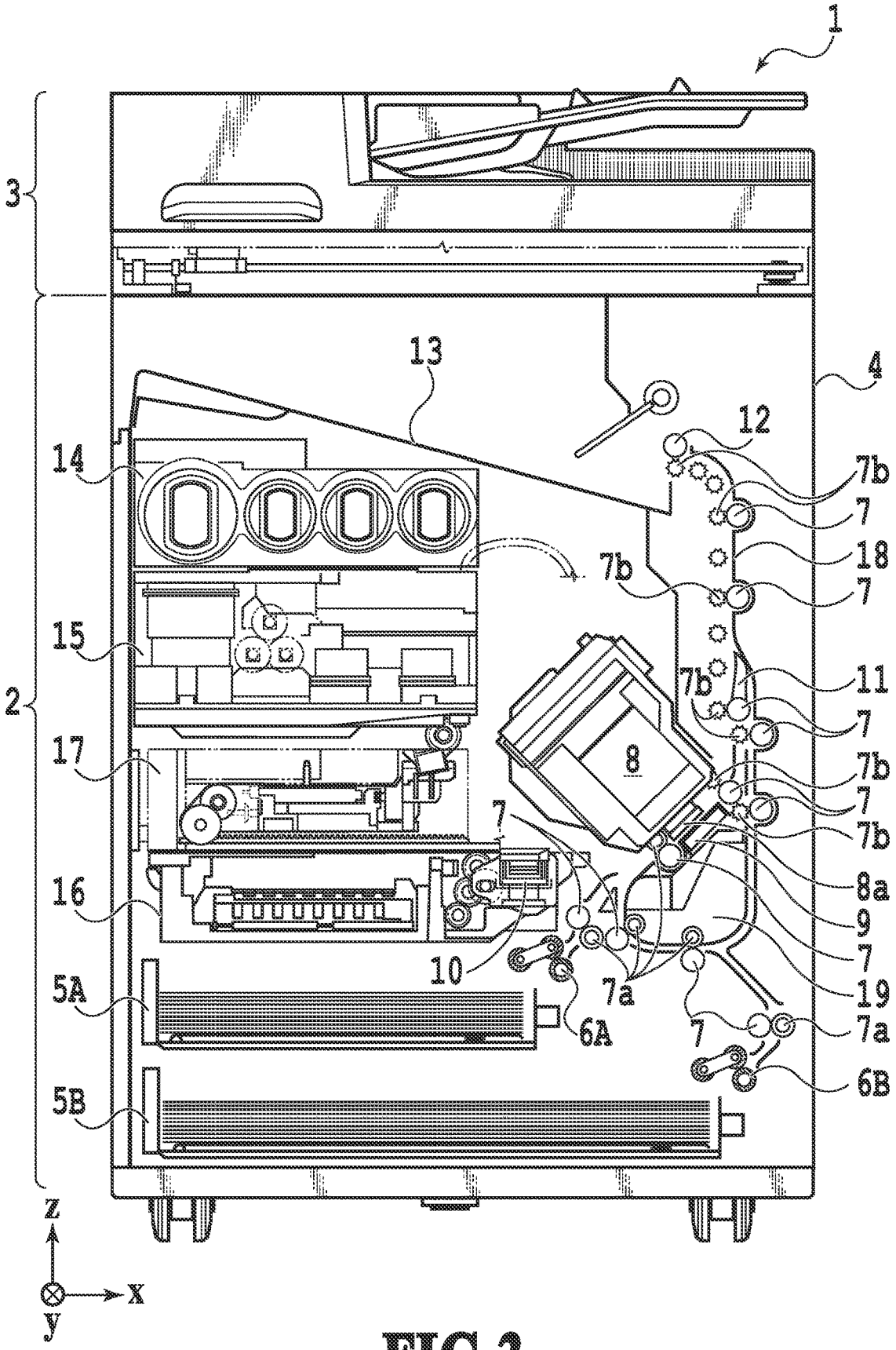
FIG. 3 is a diagram of the printing apparatus being in a printing state.

FIG. 3 is a diagram illustrating the printing apparatus 1 being in a printing state. As compared to the standby state illustrated in FIG. 1, the cap unit 10 is separated from the ejection opening surface 8*a* of the print head 8 and the ejection opening surface 8*a* faces the platen 9. In the present embodiment, the plane of the platen 9 is inclined at about 45° relative to the horizontal direction. Further, the ejection opening surface 8*a* of the print head 8 in the printing position is also inclined at about 45° relative to the horizontal direction so as to keep a constant distance from the platen 9.

In a case of moving the print head 8 from the standby position illustrated in FIG. 1 to the printing position illustrated in FIG. 3, the print controller 202 uses the maintenance control unit 210 to lower the cap unit 10 to the retracted position illustrated in FIG. 3. Thus, the ejection opening surface 8*a* of the print head 8 is separated from a cap member 10*a*. Then, the print controller 202 uses the head carriage control unit 208 to rotate the print head 8 by 45° while adjusting the height of the print head 8 in the vertical direction such that the ejection opening surface 8*a* faces the platen 9. In a case of moving the print head 8 from the printing position to the standby position after completion of a print operation, the print controller 202 performs a reversed procedure of the above procedure.

Next, an explanation is given of the conveyance path of a print medium S in the print unit 2. In a case where a print command is input, the print controller 202 firstly uses the maintenance control unit 210 and the head carriage control unit 208 to move the print head 8 to the printing position illustrated in FIG. 3. Then, the print controller 202 uses the conveyance control unit 207 to drive either one of the first feeding unit 6A and the second feeding unit 6B in accordance with the print command, so as to feed a print medium S.

Figure 4C:
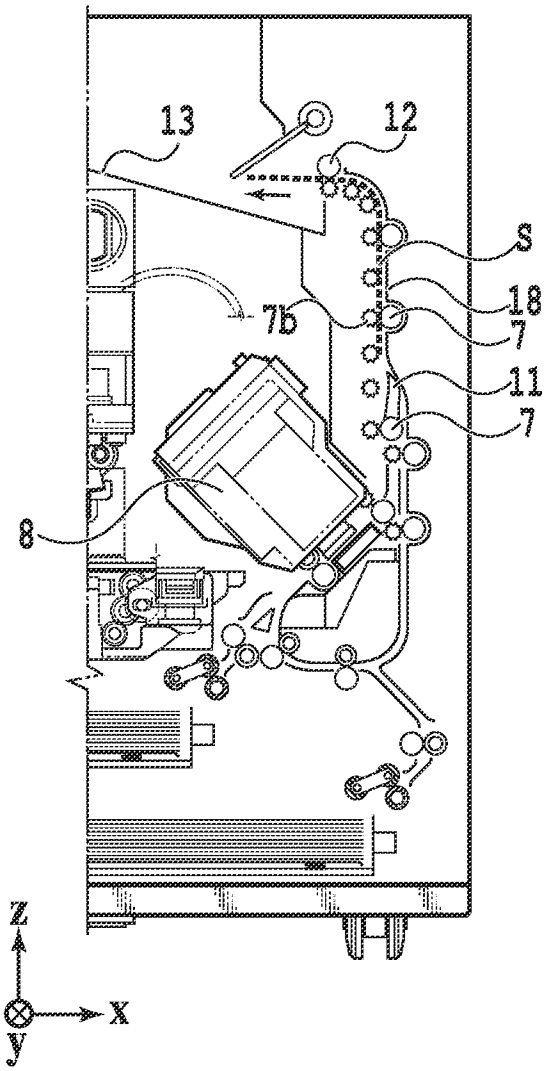
FIG. 4C is a diagram of the conveyance path for a print medium fed from the first cassette.
Figure 4B:
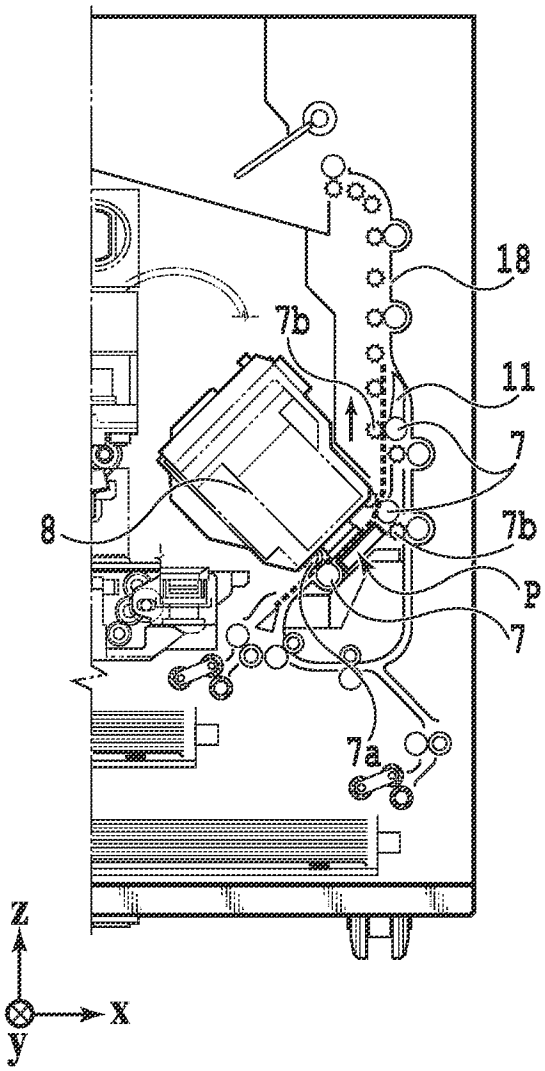
FIG. 4B is a diagram of the conveyance path for a print medium fed from the first cassette.
Figure 4A:
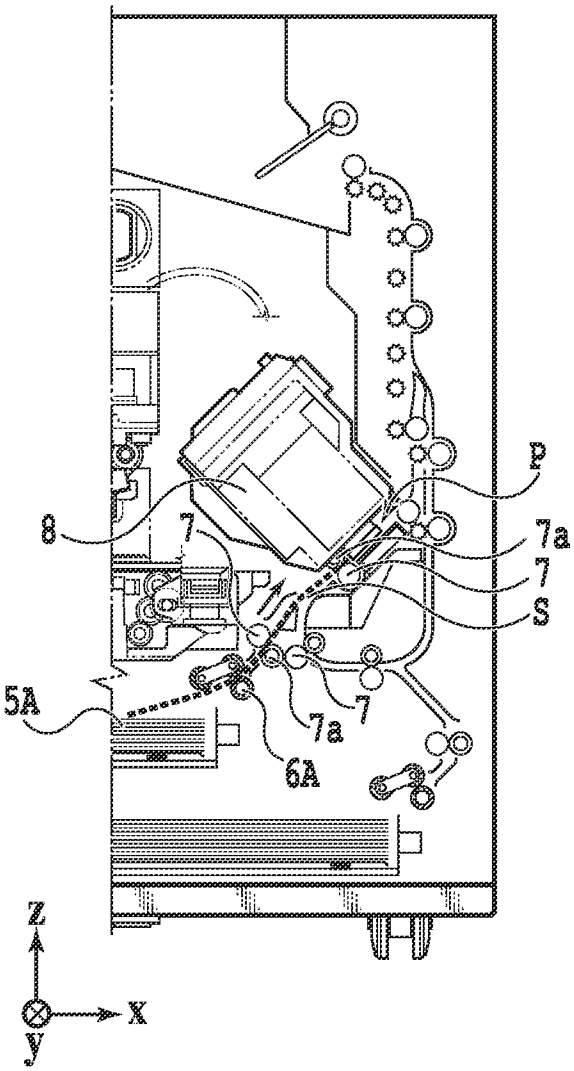
FIG. 4A is a diagram of a conveyance path for a print medium fed from a first cassette.

FIGS. 4A to 4C are diagrams illustrating a conveyance path in a case where an A4-sized print medium S, which is housed in the first cassette 5A, is fed. A print medium S stacked on the top inside the first cassette 5A is separated from the second and subsequent sheets of print media by the first feeding unit 6A. Then, the print medium S is nipped by the conveying rollers 7 and the pinch rollers 7*a* so as to be conveyed toward a print area P between the platen 9 and the print head 8. FIG. 4A is a diagram illustrating a conveyance state immediately before the leading end of the print medium S reaches the print area P. The traveling direction of the print medium S is changed from the horizontal direction (i.e., x-direction) to a direction inclined approximately at about 45° relative to the horizontal direction by the time when the print medium S reaches the print area P after being fed by the first feeding unit 6A.

In the print area P, ink is ejected toward the print medium S from a plurality of ejection openings provided in the print head 8. The back surface of the print medium S in the area to which ink is applied is supported by the platen 9, such that the distance between the ejection opening surface 8*a* and the print medium S is kept constant. After ink is applied to the print medium S, the print medium S is guided by the conveying rollers 7 and the spurs 7*b* to pass through the left side of the flapper 11, whose tip is inclined to the right, and is conveyed upward in the vertical direction along the guide 18 in the printing apparatus 1. FIG. 4B illustrates a state in which the leading end of the print medium S has passed through the print area P and is conveyed upward in the vertical direction. The traveling direction of the print medium S has been changed by the conveying rollers 7 and the spurs 7*b* from the position in the print area P, which is inclined at about 45° relative to the horizontal direction, to a vertically upward direction.

After the print medium S is conveyed upward in the vertical direction, the print medium S is discharged onto the discharging tray 13 by the discharging roller 12 and the spurs 7*b*. FIG. 4C illustrates a state in which the leading end of the print medium S has passed through the discharging roller 12 and is discharged onto the discharging tray 13. The discharged print medium S is retained on the discharging tray 13 with the surface on which an image is printed by the print head 8 down.

Figure 5C:
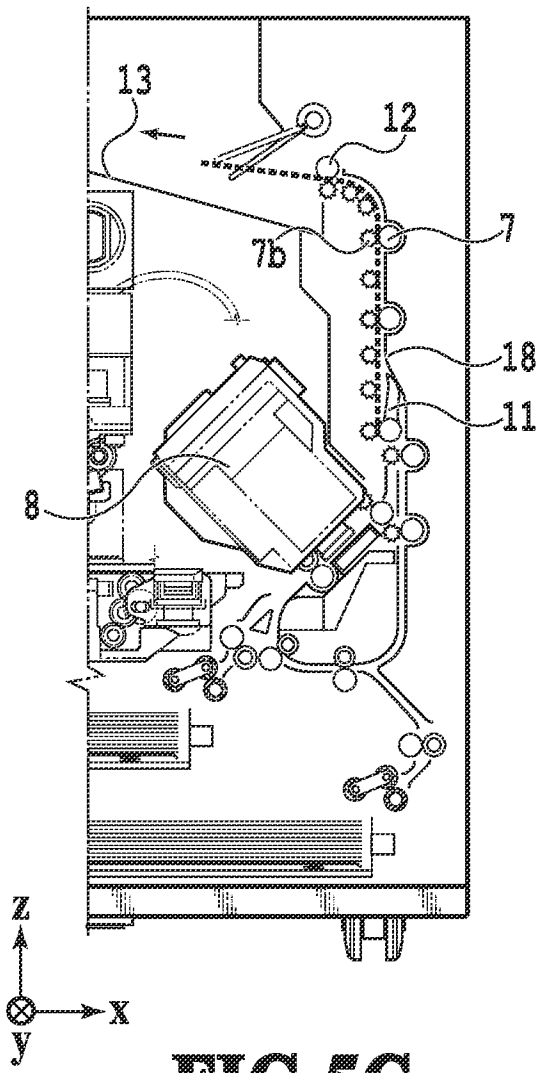
FIG. 5C is a diagram of the conveyance path for a print medium fed from the second cassette.
Figure 5B:
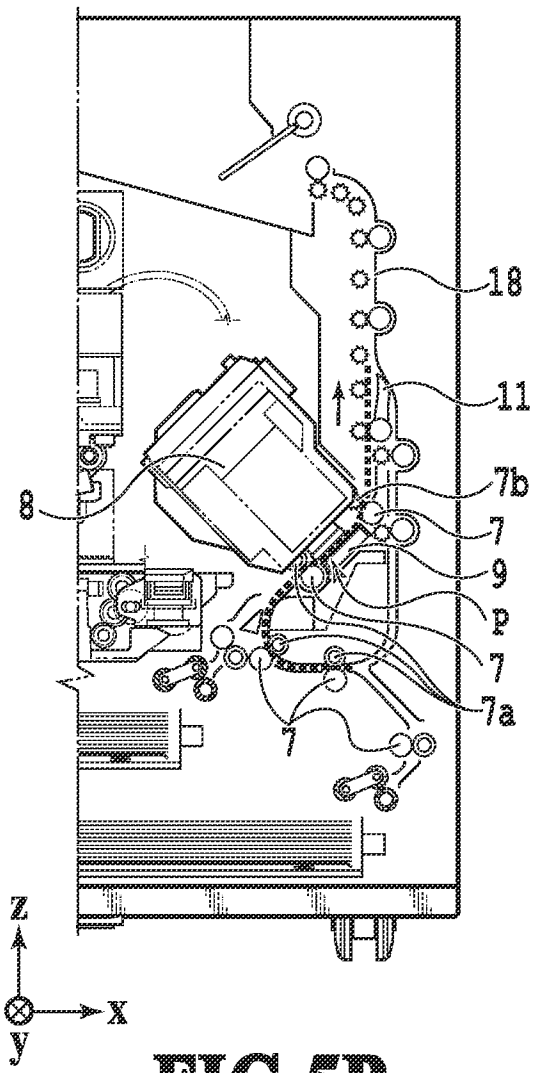
FIG. 5B is a diagram of the conveyance path for a print medium fed from the second cassette.
Figure 5A:
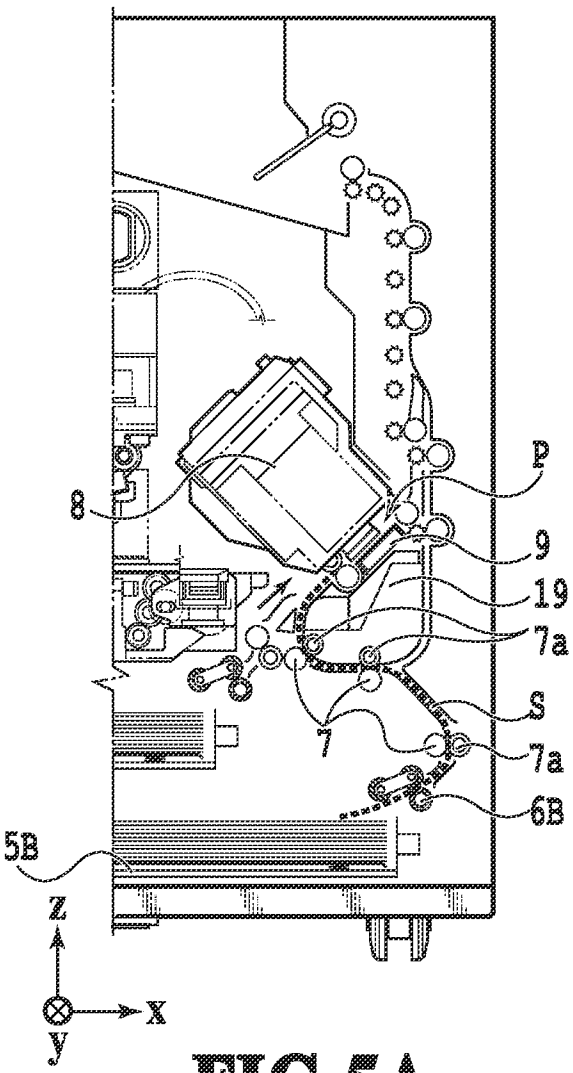
FIG. 5A is a diagram of a conveyance path for a print medium fed from a second cassette.

FIGS. 5A to 5C are diagrams illustrating a conveyance path in a case where an A3-sized print medium S, which is housed in the second cassette 5B, is fed. A print medium S stacked on the top inside the second cassette 5B is separated from the second and subsequent sheets of print media by the second feeding unit 6B. Then, the print medium S is nipped by the conveying rollers 7 and the pinch rollers 7*a* so as to be conveyed toward the print area P between the platen 9 and the print head 8.

FIG. 5A illustrates a conveyance state immediately before the leading end of the print medium S reaches the print area P. In the conveyance path through which the print medium S is fed by the second feeding unit 6B and reaches the print area P, a plurality of conveying rollers 7, pinch rollers 7*a*, and an inner guide 19 are provided. Therefore, the print medium S is curved in an S-shape and conveyed to the platen 9.

The rest of the conveyance path is the same as that of the case for an A4-sized print medium S illustrated in FIGS. 4B and 4C. FIG. 5B illustrates a state in which the leading end of the print medium S has passed through the print area P and is conveyed upward in the vertical direction. FIG. 5C illustrates a state in which the leading end of the print medium S has passed through the discharging roller 12 and is discharged onto the discharging tray 13.

FIGS. 6A to 6D illustrate a conveyance path in a case where a print operation (double-sided printing) is performed on the back surface (i.e., second surface) of an A4-sized print medium S. In a case of performing double-sided printing, a print operation is performed on the second surface (i.e., back surface) after printing on the first surface (i.e., front surface). The conveyance procedure for printing on the first surface is the same as that of FIGS. 4A to 4C, and thus the explanation thereof is omitted here. Hereafter, an explanation is given of the conveyance procedure after FIG. 4C.

Figure 6D:
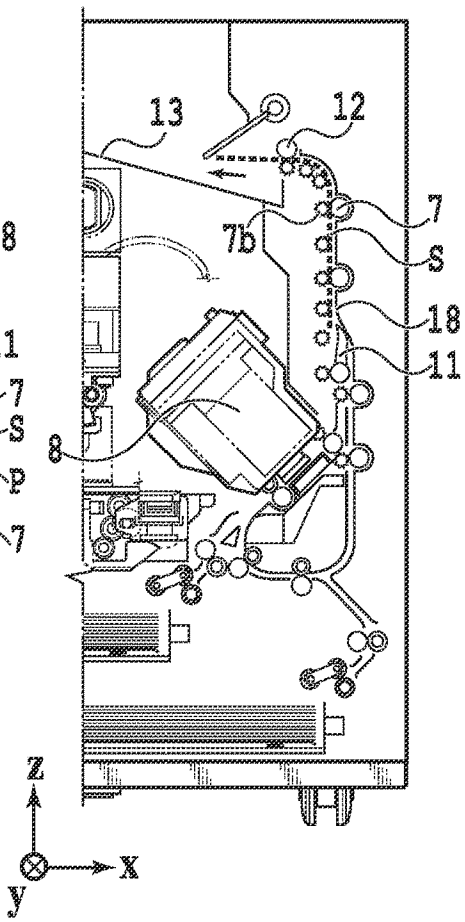
FIG. 6D is a diagram of the conveyance path in the case where a print operation is performed on the back surface of a print medium.
Figure 6C:
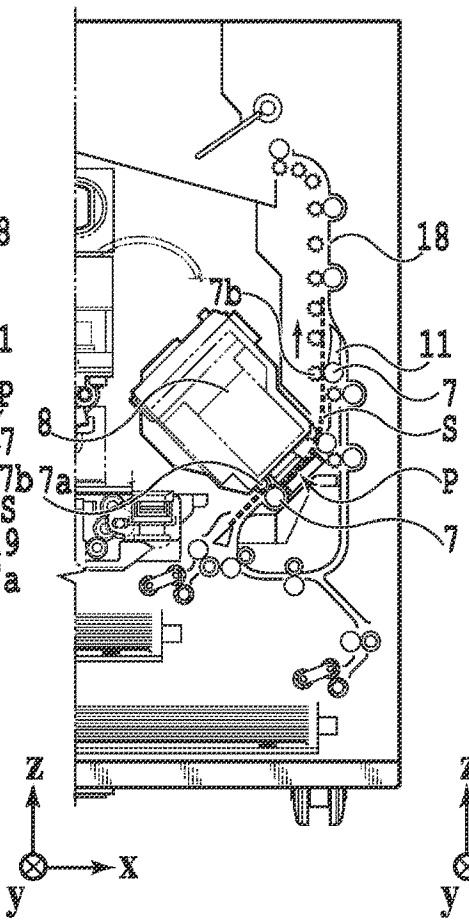
FIG. 6C is a diagram of the conveyance path in the case where a print operation is performed on the back surface of a print medium.
Figure 6B:
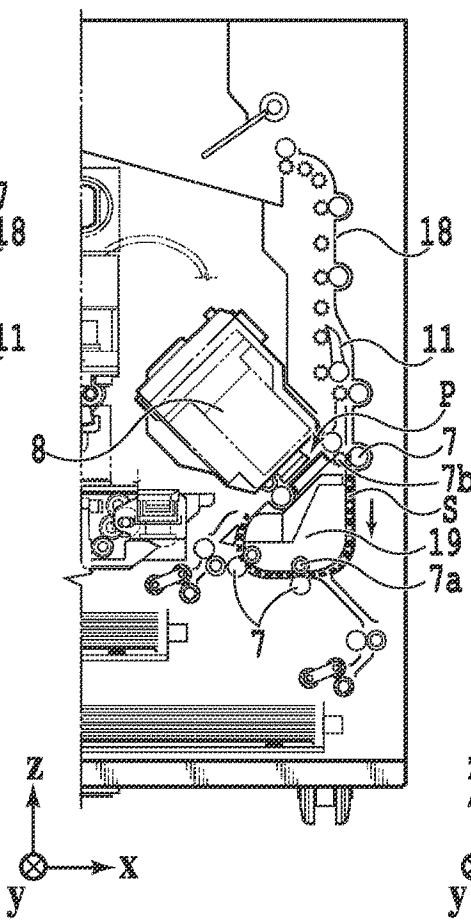
FIG. 6B is a diagram of the conveyance path in the case where a print operation is performed on the back surface of a print medium.
Figure 6A:
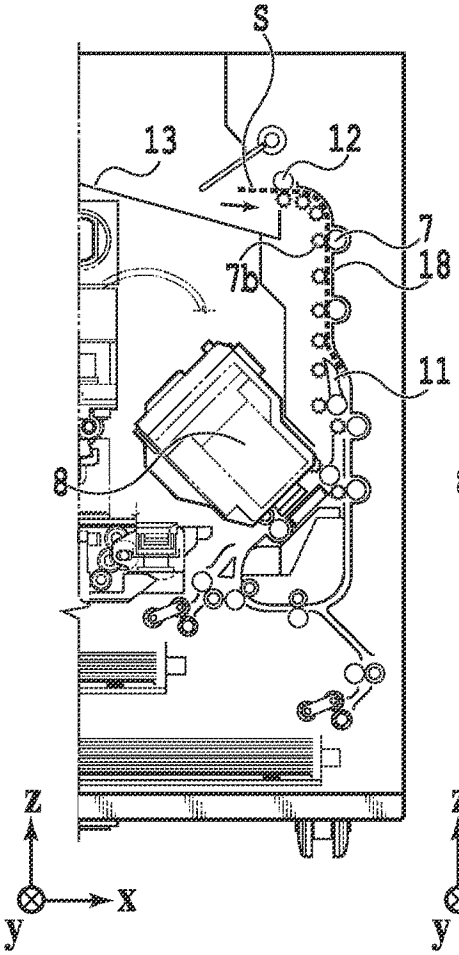
FIG. 6A is a diagram of a conveyance path in a case where a print operation is performed on the back surface of a print medium.

In a case where the print operation on the first surface by the print head 8 is completed and the rear end of the print medium S has passed by the flapper 11, the print controller 202 reversely rotates the conveying rollers 7 to convey the print medium S inward the printing apparatus 1. Here, since the flapper 11 is controlled by an actuator, which is not herein illustrated, so that the tip thereof is inclined to the left, the leading end of the print medium S (i.e., rear end in the print operation on the first surface) passes by the right side of the flapper 11 and is conveyed downward in the vertical direction. FIG. 6A illustrates a state in which the leading end of the print medium S (i.e., rear end in the print operation on the first surface) passes by the right side of the flapper 11.

Thereafter, the print medium S is conveyed along the curved outer peripheral surface of the inner guide 19 and conveyed to the print area P between the print head 8 and the platen 9 again. Here, the second surface of the print medium S faces the ejection opening surface 8*a* of the print head 8. FIG. 6B illustrates a conveyance state immediately before the leading end of the print medium S reaches the print area P for the print operation on the second surface.

The rest of the conveyance path is the same as that of the case of printing on the first surface illustrated in FIGS. 4B and 4C. FIG. 6C illustrates a state in which the leading end of the print medium S has passed through the print area P and is conveyed upward in the vertical direction. Here, the flapper 11 is controlled by an actuator, which is not herein illustrated, to move to a position in which the tip thereof is inclined to the right. FIG. 6D illustrates a state in which the leading end of the print medium S has passed through the discharging roller 12 and is discharged onto the discharging tray 13.

Next, an explanation is given of the maintenance operation for the print head 8. As explained with reference to FIG. 1, the maintenance unit 16 according to the present embodiment is provided with the cap unit 10 and the wiping unit 17 and operates the cap unit 10 and the wiping unit 17 at predetermined timings to perform the maintenance operation.

Figure 7:
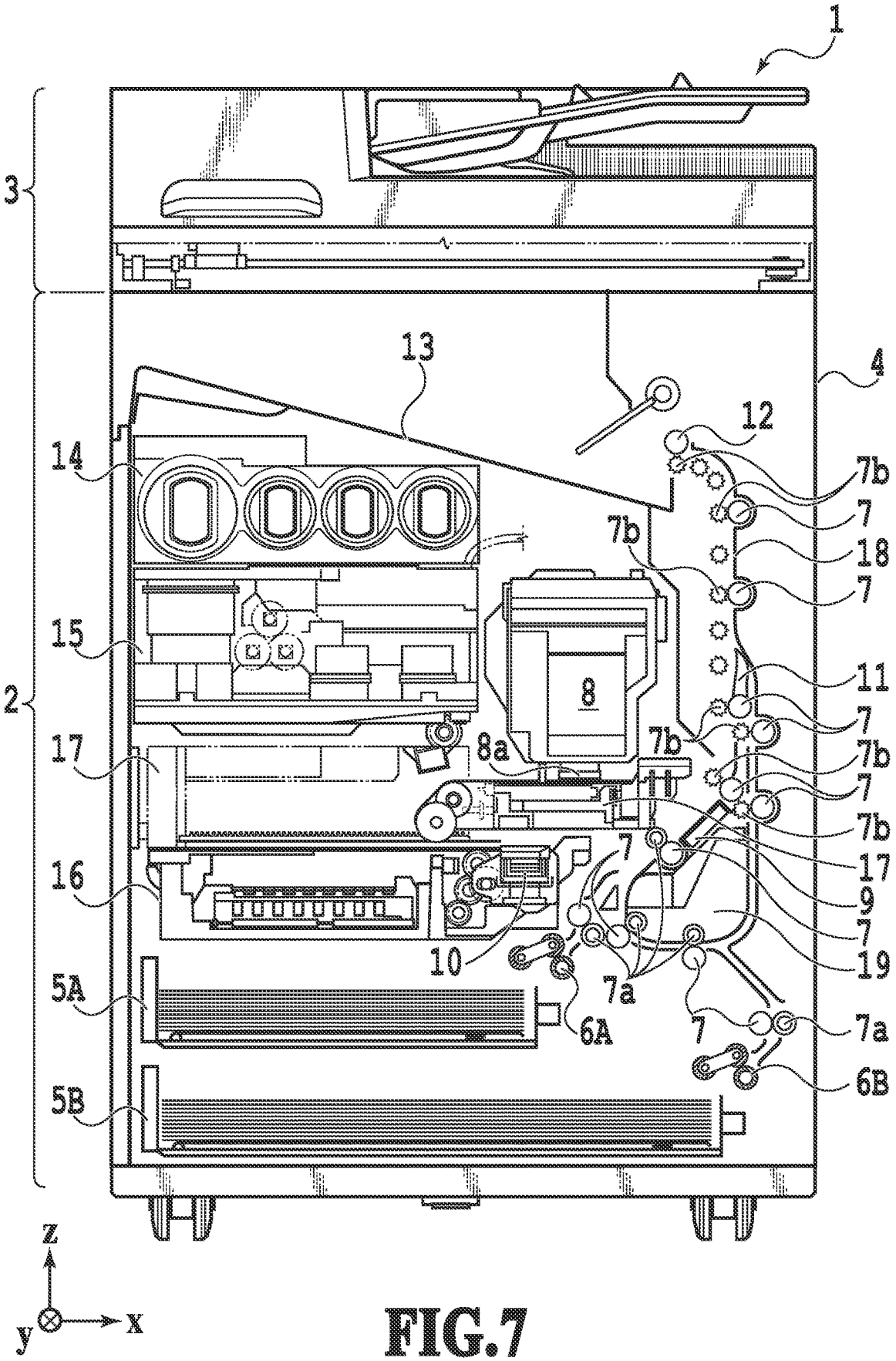
FIG. 7 is a diagram of the printing apparatus being in a maintenance state.

FIG. 7 is a diagram illustrating the printing apparatus 1 in the maintenance state. In a case of moving the print head 8 from the standby position illustrated in FIG. 1 to the maintenance position illustrated in FIG. 7, the print controller 202 moves the print head 8 upward in the vertical direction and moves the cap unit 10 downward in the vertical direction. Then, the print controller 202 moves the wiping unit 17 in the right direction as illustrated in FIG. 7 from the retracted position. Subsequently, the print controller 202 moves the print head 8 downward in the vertical direction to the maintenance position in which the maintenance operation can be performed.

On the other hand, in a case of moving the print head 8 from the printing position illustrated in FIG. 3 to the maintenance position illustrated in FIG. 7, the print controller 202 moves the print head 8 upward in the vertical direction while rotating the print head 8 by 45°. Then, the print controller 202 moves the wiping unit 17 in the right direction from the retracted position. Subsequently, the print controller 202 moves the print head 8 downward in the vertical direction to the maintenance position in which the maintenance operation can be performed by the maintenance unit 16.

Figure 8A:
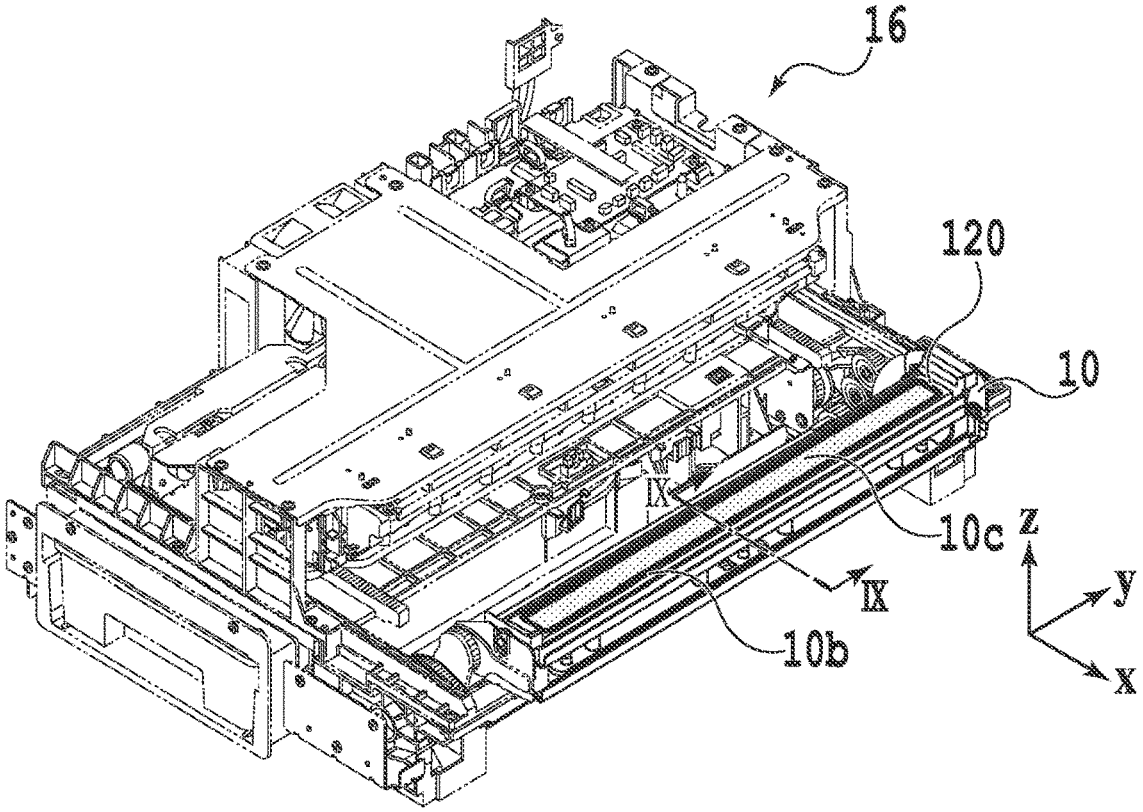
FIG. 8A is a perspective view illustrating a configuration of a maintenance unit.
Figure 8B:
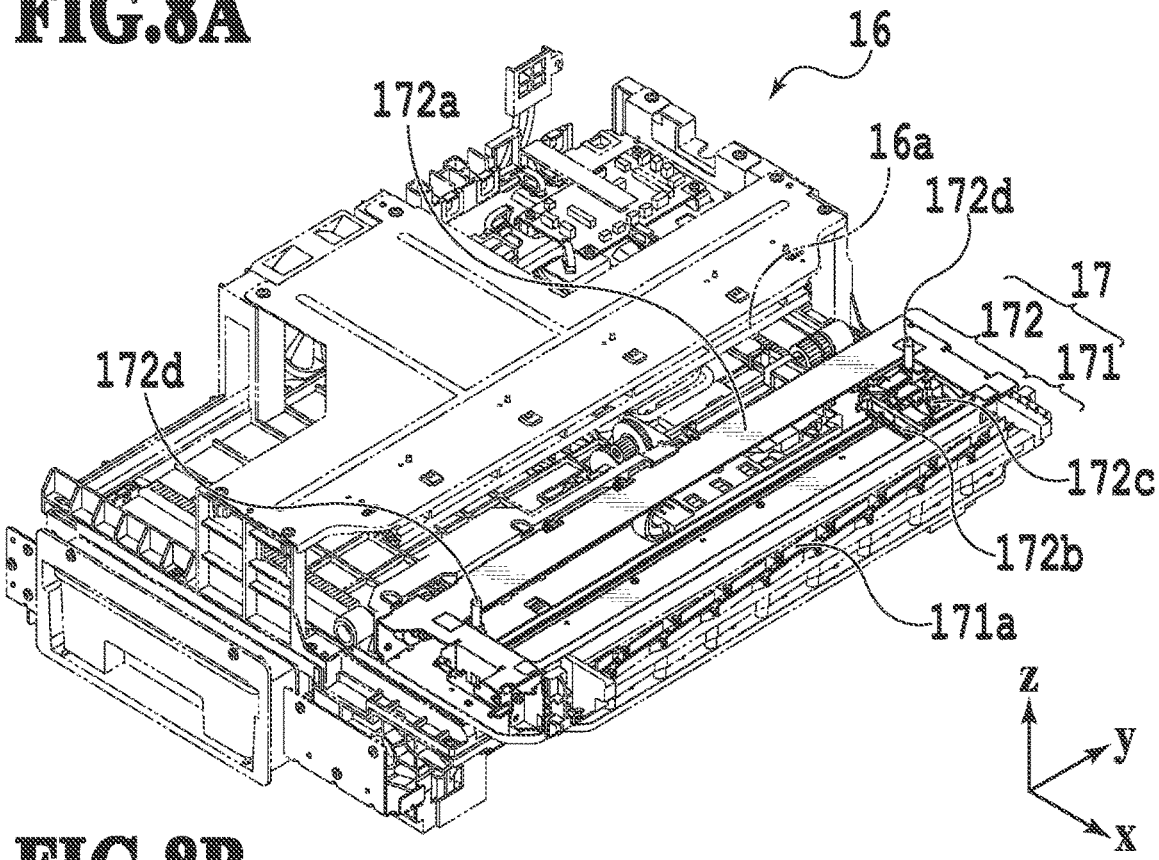
FIG. 8B is a perspective view illustrating the configuration of the maintenance unit.

FIG. 8A is a perspective view illustrating the maintenance unit 16 being in a standby position, and FIG. 8B is a perspective view illustrating the maintenance unit 16 being in a maintenance position. FIG. 8A corresponds to FIG. 1, and FIG. 8B corresponds to FIG. 7. In a case where the print head 8 is in the standby position, the maintenance unit 16 is in the standby position as illustrated in FIG. 8A. Further, the cap unit 10 has moved upward in the vertical direction and the wiping unit 17 is accommodated inside the maintenance unit 16. The cap unit 10 includes a box-shaped cap member 10*a*, which extends in y-direction. By bringing the cap member 10*a* into tight contact with the ejection opening surface 8*a* of the print head 8, it is possible to suppress evaporation of ink from the ejection openings. In addition, the cap unit 10 is further provided with a function of collecting ink, which has been ejected onto the cap member 10*a* for preliminary ejection or the like, and suctioning the collected ink by use of a suctioning pump, which is not herein illustrated.

On the other hand, in the maintenance position illustrated in FIG. 8B, the cap unit 10 has moved downward in the vertical direction, and the wiping unit 17 has been withdrawn from the maintenance unit 16. The wiping unit 17 is provided with two wiper units: a blade wiper unit 171 and a vacuum wiper unit 172.

In the blade wiper unit 171, a blade wiper 171*a* for wiping the ejection opening surface 8*a* in x-direction is provided such that the length of the blade wiper 171*a* in y-direction corresponds to the length of the area in which ejection openings are arrayed. In a case of performing a wiping operation by use of the blade wiper unit 171, the wiping unit 17 moves the blade wiper unit 171 in x-direction with the position of the print head 8 fixed at such a height that the print head 8 can make contact with the blade wiper 171*a*. By that movement, ink, or the like, adhered to the ejection opening surface 8*a* is wiped off by the blade wiper 171*a*.

At an opening of the maintenance unit 16 for housing the blade wiper 171*a*, a wet wiper cleaner 16*a* for removing ink adhered to the blade wiper 171*a* and applying a wet fluid to the blade wiper 171*a* is provided. Every time the blade wiper 171*a* is housed in the maintenance unit 16, the wet wiper cleaner 16*a* removes adhered objects and applies a wet fluid to the blade wiper 171*a*. Further, since the wet fluid is transferred to the ejection opening surface 8*a* next time the ejection opening surface 8*a* is wiped, the slipperiness between the ejection opening surface 8*a* and the blade wiper 171*a* is improved.

On the other hand, the vacuum wiper unit 172 includes: a flat plate 172*a* having an opening part extending in y-direction; a carriage 172*b* movable in y-direction inside the opening part; and a vacuum wiper 172*c* mounted on the carriage 172*b*. The vacuum wiper 172*c* is provided so as to be capable of wiping the ejection opening surface 8*a* in y-direction as the carriage 172*b* moves. At the tip of the vacuum wiper 172*c*, a suctioning port connected to a suctioning pump, which is not herein illustrated, is formed. Therefore, in a case of moving the carriage 172*b* in y-direction while operating the suctioning pump, ink or the like adhered to the ejection opening surface 8*a* of the print head 8 is wiped by the vacuum wiper 172*c* and absorbed into the suctioning port. Here, the flat plate 172*a* and position fixing pins 172*d* provided at both ends of the opening part are utilized for adjusting the position of the ejection opening surface 8*a* relative to the vacuum wiper 172*c*.

In the present embodiment, it is possible to perform the first wiping processing, in which a wiping operation by the blade wiper unit 171 is performed and a wiping operation by the vacuum wiper unit 172 is not performed, and the second wiping processing, in which both wiping processes are performed in order. In a case where the first wiping processing is performed, the print controller 202 firstly withdraws the wiping unit 17 from the maintenance unit 16 with the print head 8 retracted above the maintenance position illustrated in FIG. 7 in the vertical direction.

Subsequently, the print controller 202 moves the print head 8 downward in the vertical direction to a position where the print head 8 can make contact with the blade wiper 171*a* and then moves the wiping unit 17 into the maintenance unit 16. By that movement, ink, or the like, adhered to the ejection opening surface 8*a* is wiped off by the blade wiper 171*a*. That is, the blade wiper 171*a* wipes the ejection opening surface 8*a* when moving from the position where the blade wiper 171*a* is withdrawn from the maintenance unit 16 into the maintenance unit 16.

When the blade wiper unit 171 is housed, the print controller 202 then moves the cap unit 10 upward in the vertical direction to bring the cap member 10*a* into tight contact with the ejection opening surface 8*a* of the print head 8. Subsequently, in that state, the print controller 202 drives the print head 8 to perform preliminary ejection and suctions ink collected in the cap member 10*a* by use of the suctioning pump.

On the other hand, in a case of performing the second wiping processing, the print controller 202 firstly slides and withdraws the wiping unit 17 from the maintenance unit 16 with the print head 8 retracted above the maintenance position illustrated in FIG. 7 in the vertical direction. Subsequently, the print controller 202 moves the print head 8 downward in the vertical direction to the position where the print head 8 can make contact with the blade wiper 171*a* and then moves the wiping unit 17 into the maintenance unit 16. Thus, the wiping operation by the blade wiper 171*a* is performed on the ejection opening surface 8*a*.

Next, the print controller 202 slides and withdraws the wiping unit 17 from the maintenance unit 16 to a predetermined position with the print head 8 retracted above the maintenance position illustrated in FIG. 7 in the vertical direction again. Subsequently, the print controller 202 fixes the positions of the ejection opening surface 8*a* and the vacuum wiper unit 172 by use of the flat plate 172*a* and the position fixing pins 172*d* while lowering the print head 8 to the wiping position illustrated in FIG. 7. Then, the print controller 202 executes the above-described wiping operation by the vacuum wiper unit 172. After the print controller 202 retracts the print head 8 upward in the vertical direction and houses the wiping unit 17, the preliminary ejection into the cap member 10*a* and the operation of suctioning the collected ink are performed by the cap unit 10 in such a manner as the first wiping processing.

Hereinafter, an explanation is given of the characteristics of the present invention.

Figure 9A:
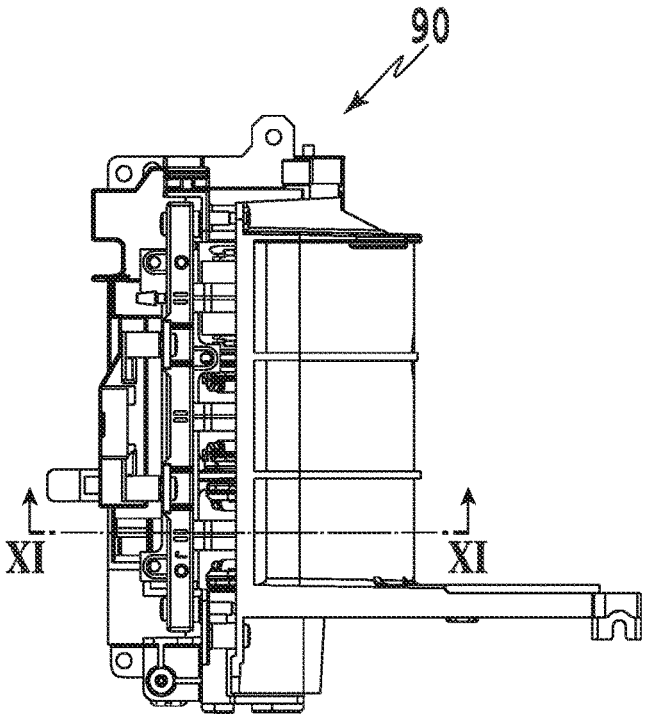
FIG. 9A is a diagram illustrating a suctioning pump provided in the printing apparatus.
Figure 9B:
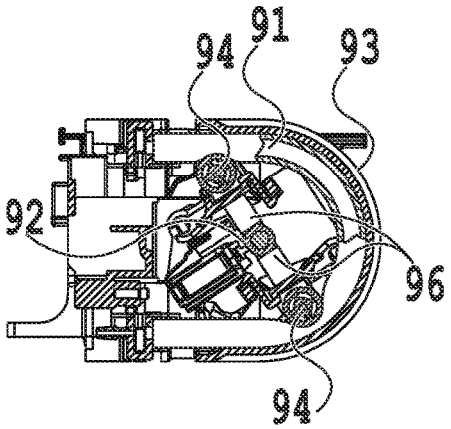
FIG. 9B is a diagram illustrating the suctioning pump provided in the printing apparatus.
Figure 9C:
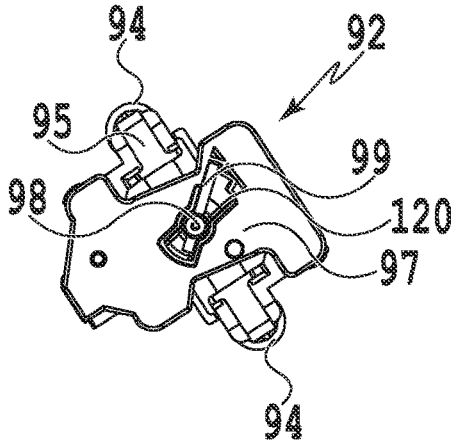
FIG. 9C is a diagram illustrating the suctioning pump provided in the printing apparatus.
Figure 9D:
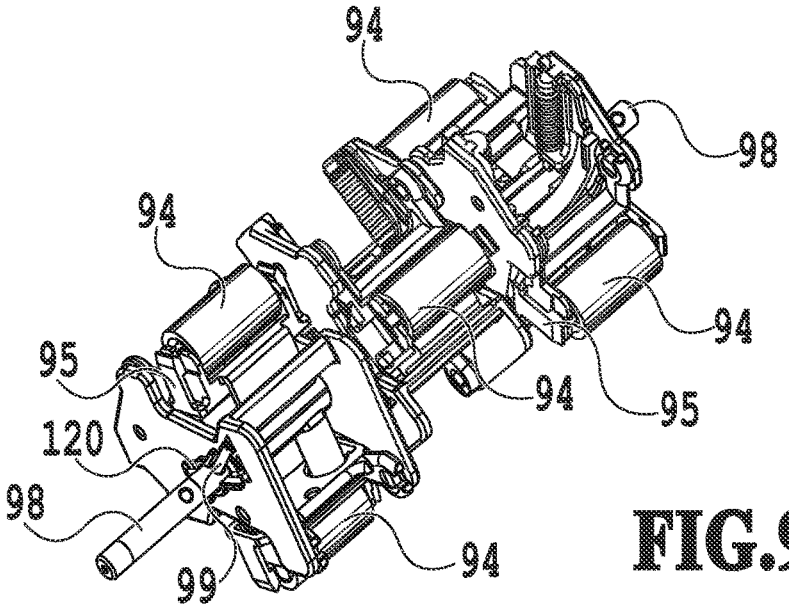
FIG. 9D is a diagram illustrating the suctioning pump provided in the printing apparatus.

FIG. 9A is a top view illustrating a suctioning pump 90 provided in the printing apparatus 1, and FIG. 9B is a cross-sectional view of the suctioning pump 90 taken along line XI-XI in FIG. 9A. Further, FIG. 9C is a diagram illustrating a pump wheel unit (i.e., holding member) 92 provided in the suctioning pump 90, and FIG. 9D is a perspective view illustrating three pump wheel units 92 that are combined. The configuration of the suctioning pump 90 includes three tubes 91 and the three pump wheel units 92, which are respectively paired, such that three rows of tube pumps are arranged in parallel and combined. The three rows (i.e., first row, second row, third row) of tube pumps all have the same configuration. Here, an explanation is given of the configuration of the tube pump in the first row as an example.

The suctioning pump 90 includes: a tube 91 formed of a flexible member; a pump wheel unit 92; and a pump cover 93 that covers the tube 91 and the pump wheel unit 92. A pump wheel unit 92 includes: two rollers 94 that squeeze a tube 91 by moving while applying pressure to the tube 91; a roller holder 95 for holding the rollers 94; and springs 96 for urging the roller holder 95. Furthermore, the pump wheel unit 92 includes a pump wheel 97 for holding the roller holder 95 and the springs 96.

In the suctioning pump 90, a pump wheel unit 92 rotates, so that the two rollers 94 themselves circulate to move while applying pressure to (i.e., maintaining a pressed state of) the tube 91 (i.e., a predetermined area thereof) and squeeze the tube 91. The tube 91 deformed by being squeezed by the rollers 94 pushes out the fluid inside the tube 91. During a normal operation, after the rollers 94 move, the crushed portion of the tube 91 returns to its original shape by the restoring force of the tube 91. Here, it is possible to suction the following fluid because of a vacuum generated inside the tube 91. The suctioning pump 90 continuously performs the above-described operation, so as to implement a pumping function including suctioning and discharging.

By rotating a shaft 98 penetrating the central part of the pump wheel unit 92, the pump wheel unit 92 is rotated by a force in a rotational direction received from a pin 99 that is integrated at right angle with the shaft 98. That is, the shaft 98 is not fixed to the pump wheel unit 92, and the pump wheel unit 92 is rotated together by the pin 99. The three pump wheel units 92 are configured to rotate on the same shaft 98, and three pins 99 are arranged with a shift of 60° from each other about the rotational center of the shaft 98. Therefore, each pump wheel unit 92 rotates in a predetermined direction in a relative positional relationship in which the phases thereof are shifted by 60° from each other about the shaft 98. By shifting the relative position of each pump wheel unit 92 by 60° as described above, the load at the time of driving the pump can be reduced.

Furthermore, the three pins 99 respectively have different lengths. Moreover, each pump wheel 97 is provided with a three-step stepped receiving part 120 for receiving a force from a pin 99. The pump wheels 97 in the first row to the third row all have the same shape. The steps of a stepped receiving part 120 are provided to correspond to the lengths of the respective pins 99, and the respective steps of the receiving part 120 are provided to match rotation angles of the pins 99 by 15° and the lengths of the pins 99. Due to the receiving parts 120 and the pins 99 provided as described above, it is possible for the pump wheel units 92 to rotate in the respectively shifted phases because of the combinations of the lengths of the pins 99 and the steps of the receiving parts 120.

Hereinafter, an explanation is given of the phases of the respective pump wheel units 92 at the time of rotation with reference to the drawings.

FIGS. 10A to 10C are diagrams illustrating the phases of the pump wheel units 92 in the first row, the second row, and the third row during a suctioning operation. The pump wheel units 92 during the suctioning operation rotate counterclockwise (i.e., in the direction of arrow A) as illustrated in the diagrams, so as to perform the suctioning operation. The pump wheel unit 92 in the first row corresponds to the first pin 99*a*, which is the longest pin, and the pump wheel unit 92 in the second row corresponds to the second pin 99*b*, which is the second longest pin. Further, the pump wheel unit 92 in the third row corresponds to the third pin 99*c*, which is the shortest pin.

During the suctioning operation, the pump wheel units 92 in all of the first row, the second row, and the third row are rotated by the forces applied in the rotational direction (i.e., the direction of arrow A) by the pins 99 to the side surfaces (i.e., wall surfaces) of the receiving parts 120 at the positions of the steps corresponding to the longest pin in the receiving parts 120. Therefore, the pump wheel units 92 rotate in a relative positional relationship having shifts by 60° from each other, as with the relative positional relationship of the respective pins 99, so as to perform the suctioning operation. By performing the suctioning operation with such 60° shifts as described above, the timings at which the rollers 94 start applying pressure to the tubes 91 and the timings at which the rollers 94 release pressure from the tubes 91 are well balanced for the respective rows, so that the load at the time of driving the pump can be distributed.

Note that, as described above, the configuration of the present embodiment includes two rollers 94 corresponding to one tube 91, so as to maintain a state in which at least one of the two rollers 94 presses the tube 91 when the pump is driven. Thereby, suctioning and discharging can be performed continuously.

Figure 11C:
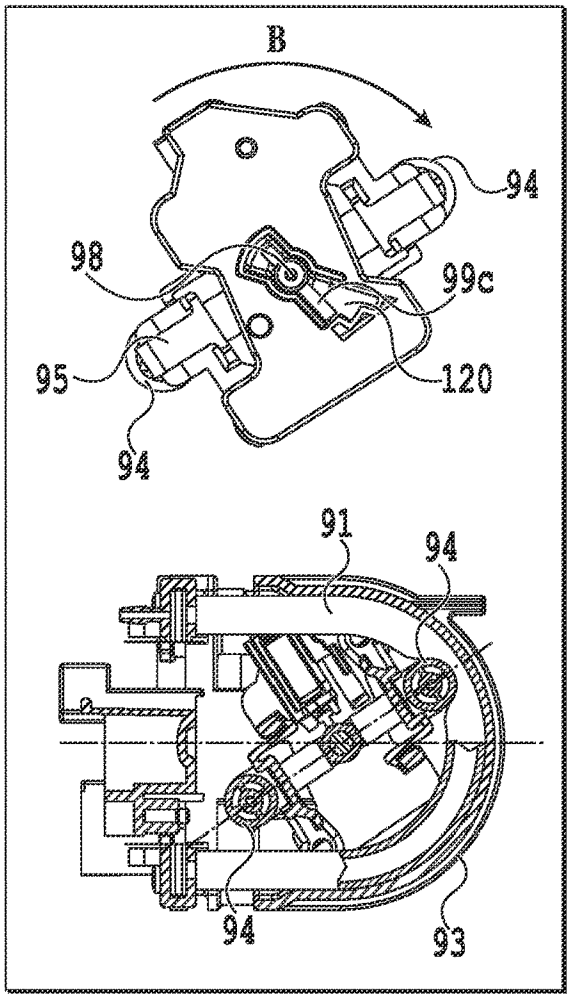
FIG. 11C is a diagram illustrating a phase of a pump wheel unit during the stopped time.
Figure 11B:
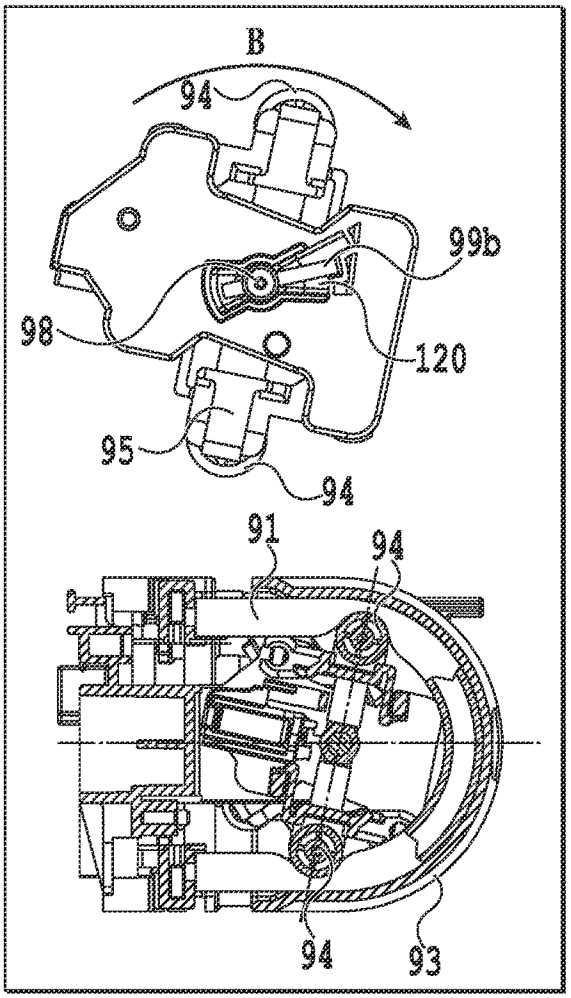
FIG. 11B is a diagram illustrating a phase of a pump wheel unit during the stopped time.
Figure 11A:
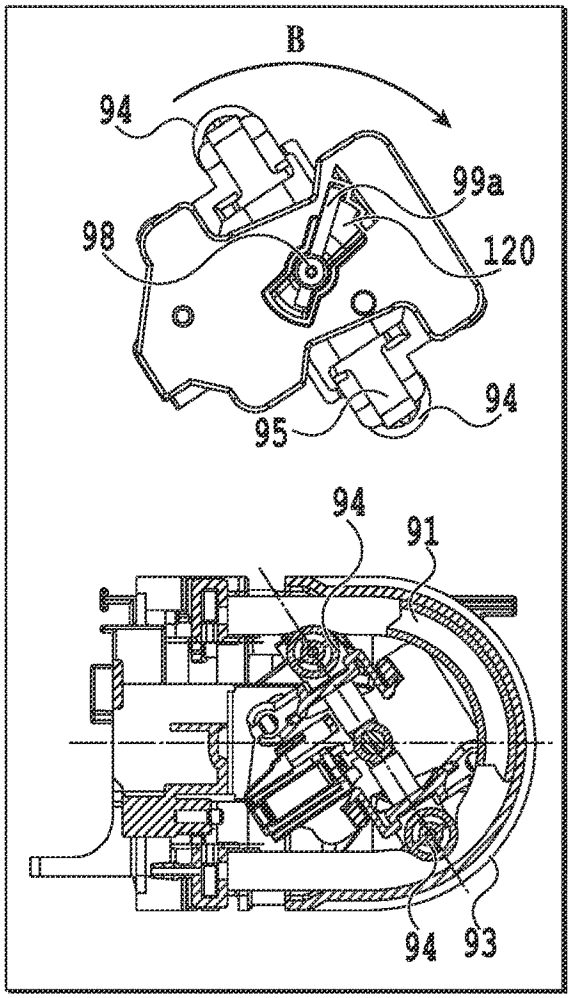
FIG. 11A is a diagram illustrating a phase of a pump wheel unit during a stopped time.

FIGS. 11A to 11C are diagrams illustrating the phases of the pump wheel units 92 in the first row, the second row, and the third row when the pump is stopped. When the suctioning operation is terminated (after rotation in the direction of arrow A), the suctioning pump 90 rotates the pump wheel units 92 by a predetermined amount clockwise (i.e., in the direction of arrow B) as illustrated in the drawings, which is the opposite direction as compared to during the suctioning operation. As described above, each pump wheel 97 is provided with the three-step stepped receiving part 120. In the pump wheel units 92 in all of the first row, the second row, and the third row, when the suctioning operation is terminated, the pins 99 are at the positions of the steps corresponding to the longest pins in the receiving parts 120. From this state, the shaft 98 and the pins 99 start rotating clockwise (i.e., in the direction of arrow B).

The pump wheel unit 92 in the first row corresponds to the first pin 99*a*, which is the longest pin, and the first pin 99*a* is positioned at the step corresponding to the longest pin in the receiving part 120. Therefore, when the shaft 98 and the pin 99*a* start rotating, the pump wheel unit 92 in the first row also starts rotating clockwise at the same timing.

The pump wheel unit 92 in the second row corresponds to the second pin 99*b*, which is the second longest pin. Even though the shaft 98 and the second pin 99*b* start rotating, the pump wheel unit 92 in the second row does not rotate immediately. That is, the pump wheel unit 92 in the second row does not rotate until the second pin 99*b* makes contact with the side wall of the step corresponding to the second longest pin in the receiving part 120.

When the second pin 99*b* rotates by 15° (after rotation starts) about the rotational center of the shaft 98, the second pin 99*b* makes contact with the side wall of the step corresponding to the second longest pin in the receiving part 120, so that the pump wheel unit 92 in the second row starts rotating. As a result, the pump wheel unit 92 in the second row rotates with a shift of 45° (i.e., with a delay corresponding to a predetermined rotation angle) as compared to the pump wheel unit 92 in the first row. That is, the position of the pump wheel unit 92 in the second row relative to the pump wheel unit 92 in the first row is fixed by the receiving part 120.

The pump wheel unit 92 in the third row corresponds to the third pin 99*c*, which is the shortest pin. Even though the shaft 98 and the third pin 99*c* start rotating, the pump wheel unit 92 in the third row does not rotate immediately. That is, the pump wheel unit 92 in the third row does not rotate until the third pin 99*c* makes contact with the side wall of the step corresponding to the shortest pin in the receiving part 120. When the third pin 99*c* rotates by 30° about the rotational center of the shaft 98, the third pin 99*c* makes contact with the side wall of the step corresponding to the shortest pin in the receiving part 120, so that the pump wheel unit 92 in the third row starts rotating. As a result, the pump wheel unit 92 in the third row rotates with a shift of 45° (i.e., with a delay corresponding to a predetermined rotation angle) as compared to the pump wheel unit 92 in the second row.

Here, regarding the amount of rotation of the shaft 98 at a stopped time, which is after the suctioning operation is terminated, the shaft 98 rotates at least until the pump wheel unit 92 in the third row starts rotating. That is, the shaft 98 rotates by a rotation angle of 30° or more. As a result, the positions of the tubes 91 to which pressure is applied by the rollers 94 are changed between the suctioning operation and the stopped time, so that the rollers 94 do not simultaneously pass through deformed portions (also referred to as creeps) of the plurality of tubes 91 when the suctioning operation is started. Therefore, it is possible to suppress a loud collision noise (noise) that occurs due to collision of a tube and a roller.

In addition, since the tube 91 is formed of a flexible member, deformation of the tube 91 is not permanent, and the tube 91 returns to its original shape as the time passes.

Therefore, the deformation barely has any influence on a suctioning operation after a predetermined amount of time passes.

In the present embodiment, 15° is taken as an example of the amount of rotation of the shaft 98 at a stopped time, which is after a suctioning operation is terminated. Hereinafter, an explanation is given of the amount of rotation (i.e., shift amount). Although the configuration in which the tube is bent in a U-shape is taken as an example in the explanation of the present embodiment, the present embodiment can be applied to straight tubes as well. First, an explanation is given of the amount of rotation (i.e., shift amount), taking straight tubes as an example.

Figure 12B:
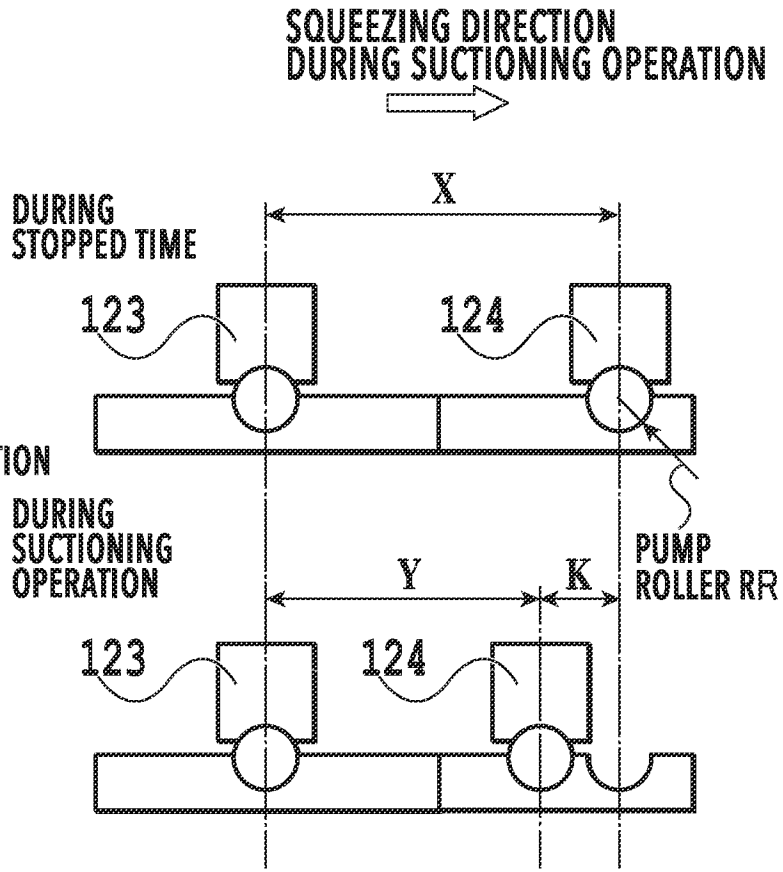
FIG. 12B is a diagram illustrating the tube pump with the straight tubes.
Figure 12A:
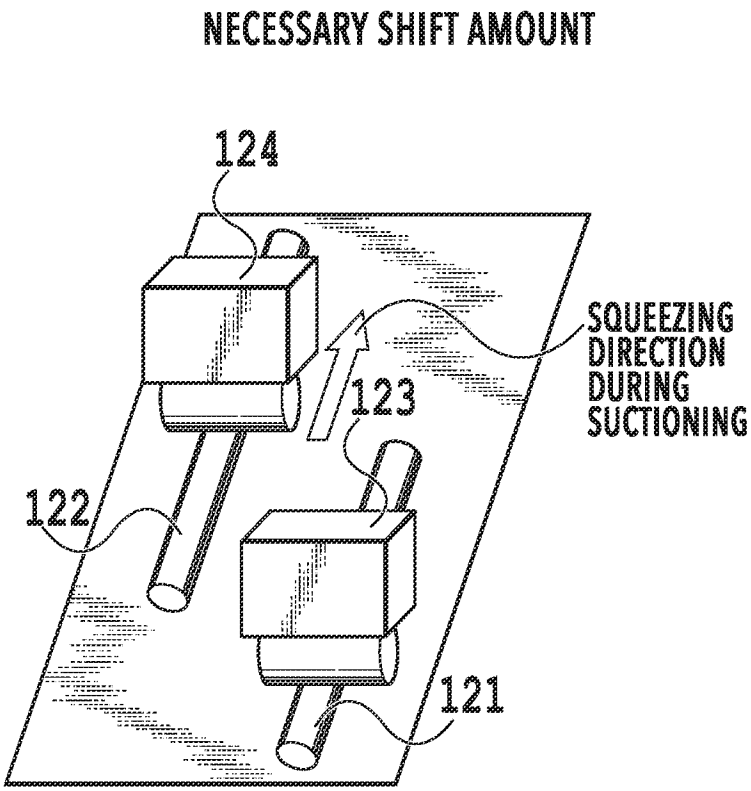
FIG. 12A is a diagram illustrating a tube pump with straight tubes.

FIGS. 12A and 12B are diagrams of straight tubes to which the present embodiment is applied. FIG. 12A is an external perspective view, and FIG. 12B is a side view of FIG. 12A. As illustrated, the tubes 121 and 122 extending in straight lines are squeezed by the rollers 123 and 124, so that the fluid inside the tubes 121 and 122 is pushed out, and thereby the pumping function is implemented. Here, the pitch between the rollers 123 and 124 is changed between a suctioning operation and a stopped time. Thereby, it is possible to suppress a loud noise volume during the suctioning operation.

In a case where: the pitch between the rollers 123 and 124 during the stopped time is X; the pitch between the rollers 123 and 124 during the suctioning operation is Y; and the difference between the pitches X and Y is K as illustrated in FIG. 12B, the following formula is established.

$$|X-Y|=K \quad \text{(Formula 1)}$$

In order to prevent the rollers 123 and 124 from simultaneously passing through deformed portions of the respective tubes 121 and 122, K, which is the difference between the pitch of the rollers 123 and 124 during the stopped time and the pitch of the rollers 123 and 124 during the suctioning operation, needs to be larger than the radius of the rollers 123 and 124. That is, if the radius of the rollers 123 and 124 is radius R, the following formula is established.

$$|X-Y|>R \quad \text{(Formula 2)}$$

$$K>R \quad \text{(Formula 3)}$$

Next, an explanation is given of the amount of rotation (i.e., shift amount), taking a configuration with a tube bent in a U-shape as in the present embodiment as an example.

Figure 13B:
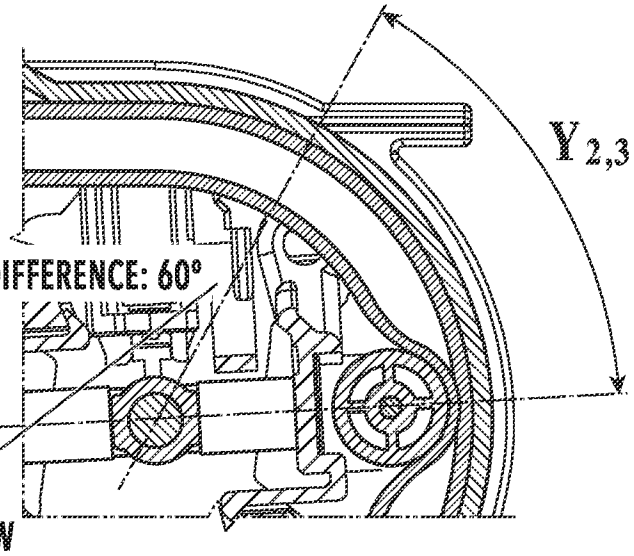
FIG. 13B is a diagram illustrating a cross section of the part of the suctioning pump.
Figure 13A:
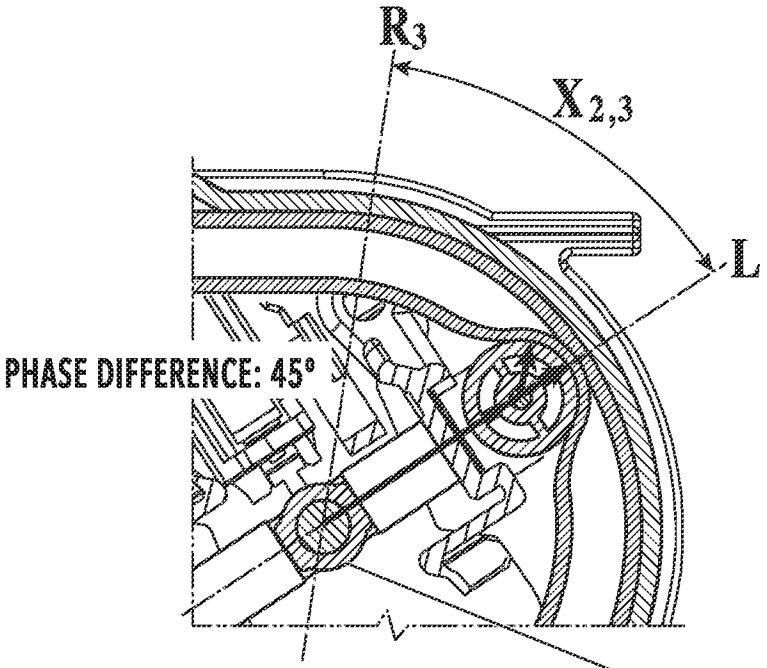
FIG. 13A is a diagram illustrating a cross section of a part of the suctioning pump.

FIGS. 13A and 13B are cross-sectional views of a part of the suctioning pump 90. FIG. 13A illustrates the positions of a roller in the third row during a stopped time and a roller in the second row, which is indicated with an imaginary line. FIG. 13B illustrates the positions of a roller in the third row during suctioning operation and a roller in the second row, which is indicated with an imaginary line. The phase difference between the roller in the second row and the roller in the third row during the suctioning operation is 60°, and the phase difference between the roller in the second row and the roller in the third row during the stopped time is 45°. Here, the distance between the roller in the second row and the roller in the third row during the stopped time on the operation trajectory made by the parts of the rollers closest to the cover surface is distance X23, and the distance between the roller in the second row and the roller in the third row during the suctioning operation on the operation trajectory made by the parts of the rollers closest to the cover surface is distance Y23. Further, if the radius of the roller in the second row is radius R2 and the radius of the roller in the third row is radius R3, the following formula is established regarding the relation between the distance on the operation trajectory and the radius of the rollers.

$$|X23-Y23|>R2 \quad \text{(Formula 4)}$$

$$|X23-Y23|>R3 \quad \text{(Formula 5)}$$

If the above formulas are applied to the present embodiment, in a case where: the radius of the cover surface is L;
the phase difference between the rollers during the stopped time is P23; and
the phase difference between the rollers during the drive operating time is Q23, distance X23 and distance Y23 are:

$$|X23=2\pi LP23/360; \text{ and}$$

$$Y23=2\pi LQ23/360.$$

Further, if $(L=27.8, R2=R3=5.5, P23=45, Q23=60)$ is applied, $$|X23-Y23|=7.28>5.5,$$

which indicates that the condition is met.

Note that, although, in the present embodiment, an explanation is given of the case of decreasing the volume of the noise that occurs when rollers that rotate in synchronization on a plurality of tubes simultaneously pass through deformed portions of the tubes, the present embodiment is not limited to the case. That is, in a tube pump configured to apply pressure to one tube by use of a plurality of rollers, it is possible to reduce the volume of the noise that occurs during a suctioning operation by making the relative positions of the plurality of rollers different between the suctioning operation and a stopped time.

In this way, the relative positions of rollers corresponding to a tube are made different between a suctioning operation and a stopped time. As a result, it has been possible to realize an inkjet printing apparatus that is capable of suppressing a loud collision noise made by a roller and a tube during a suctioning operation.

OTHER EMBODIMENTS

An explanation is given of another embodiment of the present invention with reference to the drawings. Note that the basic configuration is the same as in the above-described embodiment, and therefore only the characteristic configuration is explained below.

Figure 14:
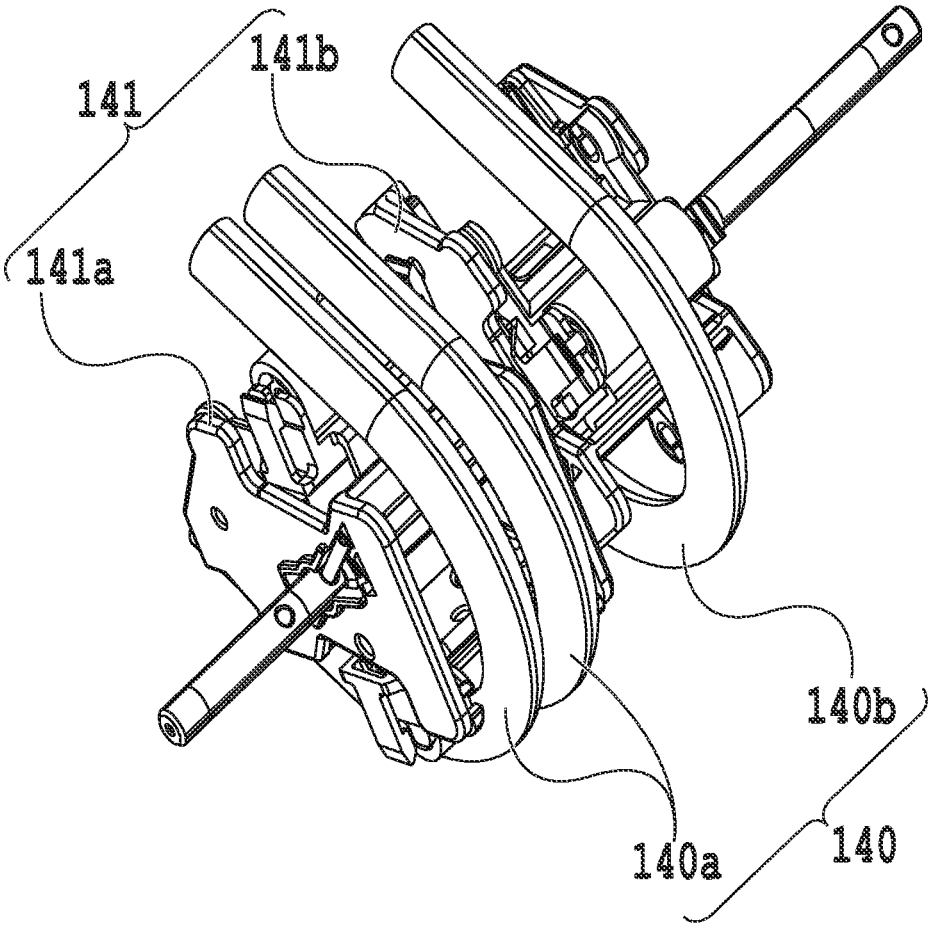
FIG. 14 is a diagram illustrating a suctioning pump in another embodiment.

FIG. 14 is a diagram illustrating a suctioning pump in the other embodiment. The configuration of the suctioning pump of the present embodiment includes three tubes 140 and two pump wheel units 141. That is, the pump wheel unit 141*a* in the first row corresponds to the two tubes 140*a*, and the pump wheel unit 141*b* in the second row corresponds to the one tube 140*b*. In such a configuration, the rollers simultaneously pass through deformed portions on the two tubes 140*a*, which correspond to the pump wheel unit 141*a* in the first row.

However, the timings at which the rollers pass through deformed portions are different on the tubes 140*a* corresponding to the pump wheel unit 141*a* in the first row and on the tube 140*b* corresponding to the pump wheel unit 141*b* in the second row. For this reason, a less noise is made as compared to a case of a configuration including three tubes and three pump wheel units, in which rollers simultaneously pass through deformed portions. Therefore, the effect of the present invention can be obtained.

Figure 15:
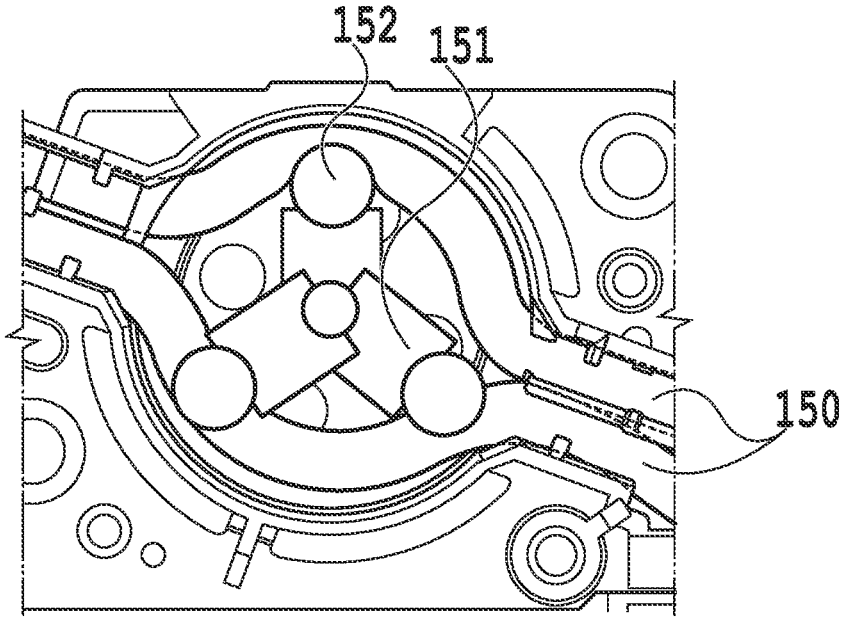
FIG. 15 is a diagram illustrating a modification example of the suctioning pump.

Further, FIG. 15 is a diagram illustrating a modification example of the suctioning pump. In the present modification example, two tubes 150 are provided, and a pump wheel unit 151 is provided with three rollers 152. By rotating the pump wheel unit 151, it is possible to transport the fluid in different directions through the two tubes 150. Even with a pump having such a configuration, by making the pitches between the rollers in the pump wheel unit 151 different between a drive operating time and a stopped time, it is possible to suppress a loud noise that occurs during a suctioning operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189636 filed Oct. 5, 2018, which are hereby incorporated by reference wherein in its entirety.

What is claimed is:

1. A liquid ejection apparatus comprising:

a cap configured to cap an ejection opening surface of a print head that ejects liquid;

a first tube connected to the cap;

a second tube connected to the cap;

a first roller configured to move while applying pressure to a predetermined area of the first tube;

a second roller configured to move while applying pressure to a predetermined area of the second tube;

a first urging unit configured to urge the first roller to the first tube;

a second urging unit configured to urge the second roller to the second tube;

a driving unit configured to drive the first roller and the second roller to move while the first roller and the second roller keep applying pressure to the first tube and the second tube, respectively; and a positioning unit configured to position the first roller and the second roller such that, in a case where the driving unit is operating, the second roller is positioned at a first position relative to the first roller and, in a case where the driving unit is stopped, the second roller is positioned at a second position relative to the first roller, the second position being different from the first position.

2. The liquid ejection apparatus according to claim 1, wherein the driving unit is capable of moving the first roller and the second roller in a first direction and in a second direction opposite to the first direction, and wherein the driving unit moves the first roller and the second roller in the first direction during a suctioning operation, in which liquid is suctioned from the cap.

3. The liquid ejection apparatus according to claim 2, wherein the driving unit moves the first roller and the second roller in the second direction after the suctioning operation is terminated and before stopping the first roller and the second roller.

4. The liquid ejection apparatus according to claim 3, wherein the driving unit is configured to move the first roller and the second roller in the second direction, so that the second roller is positioned at the second position relative to the first roller.

5. The liquid ejection apparatus according to claim 4 comprising:

a shaft configured to rotate in an axial direction by the driving unit, wherein the driving unit drives the first roller and the second roller such that the first roller and the second roller circulate around the shaft.

6. The liquid ejection apparatus according to claim 5 comprising:

a first holding member configured to hold the first roller;

a second holding member configured to hold the second roller;

a first rotating member configured to rotate in synchronization with the shaft and rotate the first holding member by abutting the first holding member; and a second rotating member shorter than the first rotating member, the second rotating member being configured to rotate in synchronization with the shaft and rotate the second holding member by abutting the second holding member, wherein the first holding member and the first rotating member are configured to start rotating in the first direction and the second direction in synchronization with rotation of the shaft, and wherein, in a case where the second holding member rotates in the second direction after rotating in the first direction, the second holding member starts to rotate in the second direction after the second rotating member has rotated by a predetermined angle in the second direction and after the second rotating member has abutted to the second holding member.

7. The liquid ejection apparatus according to claim 6, wherein the second holding member rotates with the delay of the predetermined angle after the second rotating member starts rotating, so that the second roller is positioned at the second position relative to the first roller.

8. The liquid ejection apparatus according to claim 6, wherein a length of a trajectory on the first tube pressed by the first roller while the shaft rotates for the predetermined rotation angle, is longer than a radius of the first roller.

9. The liquid ejection apparatus according to claim 6, wherein the first holding member and the second holding member are in a same shape.

* * * * *